US009259694B2

(12) United States Patent
Hanada

(10) Patent No.: US 9,259,694 B2
(45) Date of Patent: Feb. 16, 2016

(54) FLUID MIXER AND APPARATUS USING FLUID MIXER

(75) Inventor: Toshihiro Hanada, Nobeoka (JP)

(73) Assignee: ASAHI ORGANIC CHEMICALS INDUSTRY CO., LTD., Miyazaki (JP)

( * ) Notice: Subject to any disclaimer, the term of this patent is extended or adjusted under 35 U.S.C. 154(b) by 1417 days.

(21) Appl. No.: 13/057,087

(22) PCT Filed: Jul. 28, 2009

(86) PCT No.: PCT/JP2009/063716
§ 371 (c)(1),
(2), (4) Date: Feb. 1, 2011

(87) PCT Pub. No.: WO2010/016448
PCT Pub. Date: Feb. 11, 2010

(65) Prior Publication Data

US 2011/0128814 A1 Jun. 2, 2011

(30) Foreign Application Priority Data

Aug. 7, 2008 (JP) ..... 2008-204701

(51) Int. Cl.
*B01F 5/06* (2006.01)
*C10L 3/00* (2006.01)

(52) U.S. Cl.
CPC ..... *B01F 5/0646* (2013.01); *B01F 5/0614* (2013.01); *B01F 5/0644* (2013.01); *B01F 5/0647* (2013.01); *C10L 3/00* (2013.01)

(58) Field of Classification Search
CPC ..... B01F 5/0656
USPC ..... 366/336, 337, 338, 339, 340
See application file for complete search history.

(56) References Cited

U.S. PATENT DOCUMENTS 3,427,002 A * 2/1969 Wilding ..... 366/336
3,704,006 A * 11/1972 Grout et al. ..... 210/758

(Continued)

FOREIGN PATENT DOCUMENTS

CN 1062481 A 7/1992
CN 1537670 A 10/2004

(Continued)

OTHER PUBLICATIONS

Office Action dated Feb. 6, 2013, issued in corresponding Chinese Patent Application No. 200980130880.1. (7 pages).

(Continued)

*Primary Examiner* — Tony G Soohoo
*Assistant Examiner* — Anshu Bhatia
(74) *Attorney, Agent, or Firm* — Buchanan, Ingersoll & Rooney PC

(57) ABSTRACT

A fluid mixer which can mix fluid while making the distribution of concentration or distribution of temperature of the fluid in the direction of flow uniform without any unevenness and which is both compact and easy to install piping for is provided. This fluid mixer has a fluid inlet, a first flow path connected to the fluid inlet, a spiral flow path connected to the first flow path, a plurality of branch flow paths branched from the spiral flow path, a second flow path to which the plurality of branch flow paths are connected, and a fluid outlet connected to the second flow path, the plurality of branch flow paths branching from different positions of the spiral flow path and being connected with the second flow path at different positions of the second flow path.

11 Claims, 18 Drawing Sheets

(56) References Cited

U.S. PATENT DOCUMENTS

| | | | | |
|---|---|---|---|---|
| 3,977,435 | A * | 8/1976 | Bates | 137/625.3 |
| 4,165,360 | A | 8/1979 | Casper et al. | |
| 6,280,615 | B1 * | 8/2001 | Phillips et al. | 210/198.1 |
| 6,379,035 | B1 * | 4/2002 | Kubo et al. | 366/340 |
| 7,041,218 | B1 * | 5/2006 | Liles | 210/512.1 |

FOREIGN PATENT DOCUMENTS

| | | | |
|---|---|---|---|
| JP | 51-091175 | A | 8/1976 |
| JP | 54-128863 | A | 10/1979 |
| JP | 59-021932 | U | 2/1984 |
| JP | 2-307518 | A | 12/1990 |
| JP | 8-141379 | A | 6/1996 |
| JP | 8-146008 | A | 6/1996 |
| JP | 2000-140595 | A | 5/2000 |
| JP | 2001-205062 | A | 7/2001 |
| JP | 2002-243597 | A | 8/2002 |
| WO | WO 97/43219 | A1 | 11/1997 |
| WO | WO 03/078046 | A1 | 9/2003 |

OTHER PUBLICATIONS

International Search Report (PCT/ISA/210) issued on Nov. 10, 2009, by Japanese Patent Office as the International Searching Authority for International Application No. PCT/JP2009/063716.

Extended Search Report issued in corresponding European Application No. 09804931 on Apr. 28, 2015 (3 pages).

* cited by examiner (a)

(b)

FLUID MIXER AND APPARATUS USING FLUID MIXER

TECHNICAL FIELD

The present invention relates to a fluid mixer used for fluid transport piping in various industrial fields such as chemical factories, the semiconductor production field, food field, medical field, biotech field, etc., in particular relates to a fluid mixer and apparatus using a fluid mixer able to mix fluid while making the distribution of concentration or distribution of temperature of the fluid in the direction of flow uniform without any unevenness.

BACKGROUND ART

In the past, as the method of attaching a device inside of a pipe to uniformly mix fluid flowing through the inside of the pipe, as shown in FIG. 16, use of a swirl blade type static mixer element 81 has been the general practice (see, for example, Japanese Patent Publication (A) No. 2001-205062). Usually, the static mixer element 81 is comprised of a square plate twisted 180 degrees about its longitudinal axis as a minimum unit member and has a plurality of such minimum unit members integrally connected in series so that the twisting directions become mutually different directions. This static mixer element 81 is arranged in a pipe 82, male connectors 83 are attached to the two end parts of the pipe 82, flare nuts 85 are attached, and fastening nuts 84 are fastened, whereby a static mixer is formed. At this time, the outside diameter of the static mixer element 81 is designed to be substantially equal to the inside diameter of the pipe 82, so the fluid is able to be effectively agitated.

However, the method of mixing fluid using this conventional static mixer is to agitate flowing fluid along the flow, so as shown in FIG. 17(*a*), it is possible to make the distribution of concentration in the diametrical direction of the pipe uniform without any unevenness, but as shown in FIG. 17(*b*), it is not possible to make the distribution of concentration in the axial direction (flow direction) uniform without any unevenness. For this reason, for example, when mixing water and a chemical at the upstream side of the static mixer, if the mixing ratio of the chemical temporarily increases, the fluid will pass through the static mixer in a state partially denser in concentration in the flow path. At this time, even if the water and chemical are stirred while made uniform in concentration in the diametrical direction, in the axial direction (flow direction), locations in the flow path where the concentration partially becomes denser will end up flowing to the downstream side in the dense state as they are without being diluted much at all (see FIG. 17(*b*)). Due to this, when connected to a semiconductor washing apparatus, in particular, an apparatus which directly coats the surface of a semiconductor wafer with a chemical to perform various types of treatment, there was the problem that different concentrations of the chemical were coated on the surface of the semiconductor wafer and thereby caused defects.

As a method for avoiding unevenness in the distribution of concentration in the axial direction (flow direction), the method of installing a tank in the middle of the flow path, storing the fluid temporarily in the tank, making the concentration in the tank uniform, then running the fluid (not shown) etc. may be mentioned. However, there were the problem that a large space was required for installing the tank and therefore the apparatus became larger, the problem that transport of the fluid from the tank again required a pump, piping, etc., so the number of the parts used increased, and the problem that cost was incurred for installing the pipeline. Further, with this method, the fluid stagnates in the tank. If the fluid stagnates, it becomes a cause of proliferation of bacteria, the bacteria proliferating in the tank flows into the pipeline, and, in a semiconductor production line, deposit on the semiconductor wafer and cause defects.

As another method for avoiding the unevenness in the distribution of concentration in the axial direction (flow direction), as shown in FIG. 18, there was a branching and diluting apparatus for branching flow paths and diluting the fluid (for example, see Japanese Patent Publication (A) No. 8-146008). This apparatus analyzed a sample solution flowing through a tube 91 at a constant speed. It provided a branching part 92 branching the flowing sample to a plurality of flow paths in the middle of the flow path so as to divide the sample solution, changed the inside diameters or lengths of the tubes 93 and 94 of the branch flow paths, combined the flows again at a merging part 96 before a detector 95, and utilized the time difference at which the sample solution was detected for dilution.

CITATION LIST

Japanese Patent Publication (A) No. 2001-205062 and Japanese Patent Publication (A) No. 8-146008

SUMMARY OF INVENTION

However, if using the technique of the conventional branching and diluting apparatus of FIG. 18 for a fluid transport pipe, it is necessary to provide pipelines of different lengths branched from the middle of the main pipeline and then recombine them. For this reason, it is necessary to provide a large number of branched flow paths for making the distribution of concentration in the axial direction (flow direction) uniform without any unevenness in the flow path. In this case, there was the problem of the space for providing the branched pipelines ending up becoming larger. Further, there was the problem that installation of such pipelines required a large number of parts and was both complicated and time-consuming.

The present invention was made in consideration of the above problem in the prior art and has as its object the provision of a fluid mixer and an apparatus using a fluid mixer which can mix fluid while making a distribution of concentration or distribution of temperature of the fluid in the direction of flow uniform without any unevenness and which are both compact and facilitate piping work.

Explaining the constitution of the present invention for solving the above problem, the fluid mixer has a fluid inlet, a first flow path connected to the fluid inlet, a spiral flow path connected to the first flow path, a plurality of branch flow paths branched from the spiral flow path, a second flow path to which the plurality of branch flow paths are connected, and a fluid outlet connected to the second flow path, the plurality of branch flow paths branching from different positions of the spiral flow path and being connected with the second flow path at different positions of the second flow path, as a first characterizing feature.

Further, the fluid mixer is provided with a main body part formed so that the fluid inlet is arranged at one end face, the fluid outlet is arranged at the other end face, a spiral groove is formed at an outer circumference, the second flow path is arranged coaxially with a center axis of a spiral of the spiral groove, and a plurality of communicating holes communicate the second flow path and the spiral groove and is provided with a housing fitting with an outer circumferential surface of the main body part, the spiral groove and the inner circumferential surface of the housing forming the spiral flow path and the communicating holes becoming the branch flow paths, as a second characterizing feature.

Further, the fluid mixer is provided with a main body part formed so that the fluid outlet is arranged at one end face, a spiral groove is formed at an outer circumference, the second flow path is arranged coaxially with a center axis of a spiral of the spiral groove, and a plurality of communicating holes communicate the second flow path and the spiral groove and is provided with a housing fitting with an outer circumferential surface of the main body part, the fluid inlet being formed at an outer circumference of the housing, the spiral groove and the inner circumferential surface of the housing forming the spiral flow path, and the communicating holes becoming the branch flow paths, as a third characterizing feature.

Further, in the fluid mixer, the spiral flow path is formed so that a flow section area becomes gradually smaller from one end connected with the first flow path to the other end part, as a fourth characterizing feature.

Further, in the fluid mixer, an inner circumferential surface of the second flow path is formed gradually expanding in diameter from an upstream side toward the fluid outlet, as a fifth characterizing feature.

Further, in the fluid mixer, the communicating holes are formed to be the same in flow section areas, as a sixth characterizing feature.

The housing is provided with a ferrule coupling part, as a seventh characterizing feature.

The housing is formed by two or more members, each member is provided with a flange part, and the flange parts are fastened by clamps, as an eighth characterizing feature.

The housing is comprised of two cylindrical parts, an outer circumference of one end part of each cylindrical part is provided with a flange part, while the other end part is provided with a reduced diameter part which is reduced in diameter, and the main body part is inserted into opening parts of the two cylindrical parts at the flange part sides, and the flange parts are fastened by clamps, as a ninth characterizing feature.

The housing is comprised of a body provided with a hollow chamber opening at the bottom, the hollow chamber having an inlet flow path and outlet flow path communicated with it, and a lid member closing an opening of the hollow chamber, and the main body part is arranged fit into the hollow chamber of the housing, as a 10th characterizing feature.

The fluid mixer is used to make a temperature or concentration of a flowing substance uniform in a line in which a temperature or concentration of the substance changes over time, as an 11th characterizing feature.

The substance is a gas or liquid, as a 12th characterizing feature.

The fluid mixer is used to make a mixing ratio of at least two substances uniform in a line in which a mixing ratio of the substances changes over time, as a 13th characterizing feature.

The fluid mixer is arranged at a downstream side of a merging part of a line in which at least two substances flow, as a 14th characterizing feature.

The substance is any of a gas, liquid, solid, or powder, as a 15th characterizing feature.

The substance is at least water and any one of a pH adjuster, liquid fertilizer, bleach, bactericide, surfactant, or a liquid chemical, as a 16th characterizing feature.

The substance is at least a first liquid chemical and a second liquid chemical or a metal, as a 17th characterizing feature.

The substance is at least a waste liquor and a pH adjuster, flocculant, or microorganisms, as an 18th characterizing feature.

The substance is at least a first petroleum oil, a second petroleum oil, additive, or water, as a 19th characterizing feature.

The substance is at least an adhesive and a curing agent, as a 20th characterizing feature.

The substance is any one of at least a first resin, second resin, solvent, curing agent, or coloring agent, as a 21st characterizing feature.

The substance is at least one of a first food material, second food material, food additive, seasoning, microorganisms, or nonflammable gas, as a 22nd characterizing feature.

The substance is at least air and a flammable gas, as a 23rd characterizing feature.

The substance is an at least first nonflammable gas and a second nonflammable gas or steam, as a 24th characterizing feature.

The substance is any one of at least water, liquid chemical, or a food material and any of air, a nonflammable gas, or steam, as a 25th characterizing feature.

The substance is any one of a first synthesis intermediate, second synthesis intermediate, additive, liquid chemical, or metal, as a 26th characterizing feature.

The parts of the fluid mixer of the present invention such as the main body part 7, cylindrical member 14, etc. may be made of any resin. Any of polyvinyl chloride, polypropylene (hereinafter referred to as "PP"), polyethylene, etc. may be used. In particular, when using a corrosive fluid as the fluid, polytetrafluoroethylene (hereinafter referred to as "PTFE"), polyvinylidene fluoride, tetrafluoroethylene-perfluoroalkyl vinyl ether copolymer resin (hereinafter referred to as "PFA"), or another fluororesin is preferable. If a fluororesin, use for a corrosive fluid is possible. Further, even if corrosive gas passes through the parts, there is no longer any concern over corrosion of the pipe members, so this is preferred. Further, the members forming the main body part or housing may be transparent or semitransparent members. This is preferable in that it enables the state of mixing of the fluid to be visually confirmed. Further, depending on the substance running through the fluid mixer, the parts may be made of iron, copper, copper alloy, brass, aluminum, stainless steel, titanium, or other metal or alloy.

The present invention is structured in the above way and has the following superior effects.

(1) Even in a state where the concentration of a chemical temporarily becomes denser or thinner in a flow path, it is possible to mix the fluid while making the distribution of concentration of the fluid in the direction of flow uniform without any unevenness, possible to supply a chemical in a stable concentration, and possible to prevent defects due to changing concentrations of chemicals in various industrial fields.

(2) Even in a state in which the temperature of the fluid temporarily becomes higher or becomes lower in a flow path, it is possible to mix the fluid while making the distribution of temperature of the fluid in the direction of flow uniform with no unevenness, possible to supply fluid by a stable temperature, possible to stabilize the temperature more in a hot water heater etc., and possible to prevent burns.

(3) The fluid mixer can be made smaller in size and the installation space can be kept to the minimum necessary.

(4) The piping work is easier and can be performed in a short time.

Below, it will be possible to better understand the present invention from the attached drawings and the description of the preferred embodiments of the present invention.

DESCRIPTION OF EMBODIMENTS

Figure 1:
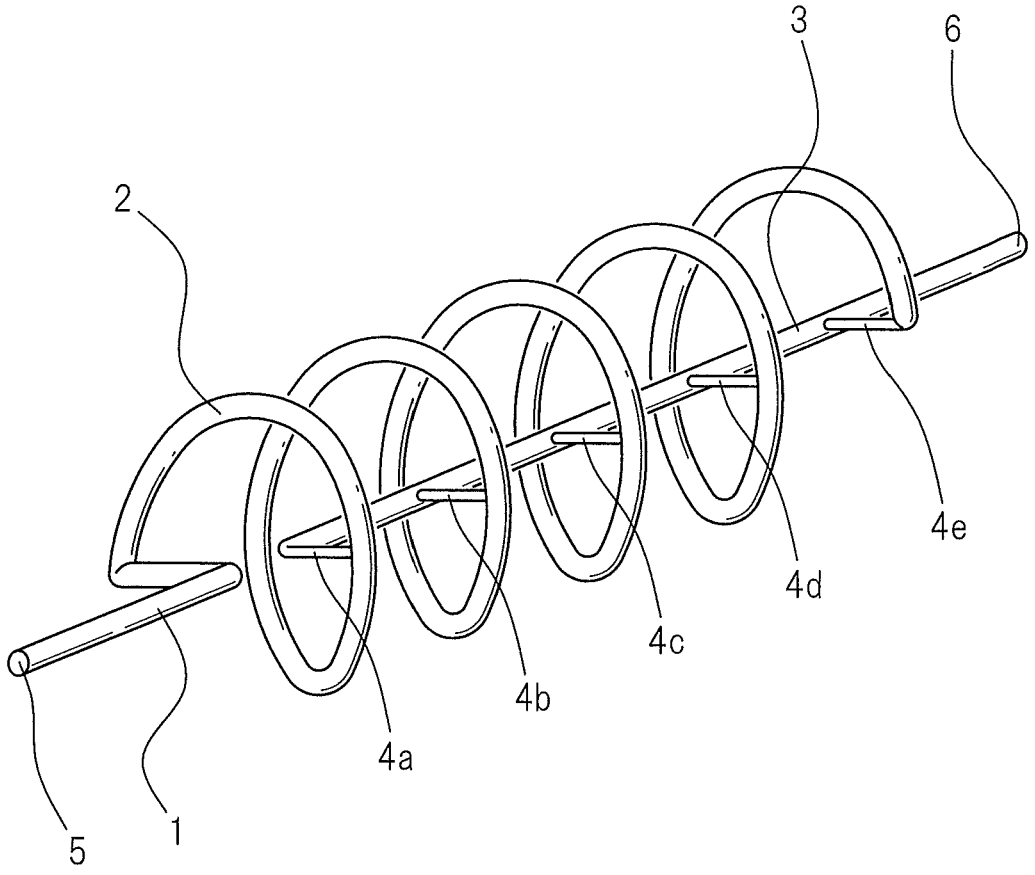
FIG. 1 is a schematic view of a pipe flow path showing a fluid mixer of a first embodiment of the present invention.

Below, embodiments of the present invention will be described with reference to the embodiments shown in the drawings, but the present invention is not limited to these embodiments needless to say. Below, referring to FIG. 1, a fluid mixer of a first embodiment of the present invention will be explained.

The fluid mixer is provided with a fluid inlet 5 into which the fluid flows, a first flow path 1 connected to the fluid inlet 5, a fluid outlet 6 from which the fluid flows, and a second flow path 3 connected to the fluid outlet 6—all on the same axis—and a spiral flow path 2 having the flow paths 1 and 3 as the center axis of the spiral. The first flow path 1 and the second flow path 3 are both straight flow paths. At one end part of the spiral flow path 2, the first flow path 1 is connected. In the middle of the spiral flow path 2, five branch flow paths 4*a* to 4*e* are provided connected to the second flow path 3. Further, the branch flow path 4*e* positioned at the location nearest to the fluid outlet 6 side is provided connected to the spiral flow path 2 at the other end part. That is, the plurality of branch flow paths 4*a* to 4*e* are branched from different positions of the spiral flow path 2 and connect with the second flow path 3 at different positions of the second flow path 3. In this embodiment, for example, tubes etc. may be used for pipe connections.

Next, the operation of the fluid mixer of the first embodiment of the present invention will be explained.

At the upstream side of the fluid mixer, the water and chemical are mixed and temporarily become weaker in chemical concentration. At this time, the partially denser concentration chemical flowing through the flow path flows in from the fluid inlet 5 to the first flow path 1 and flows to the spiral flow path 2. When the part of the denser concentration chemical flows through the location where the spiral flow path 2 is connected to the branch flow path 4*a*, part of that flows through the branch flow path 4*a*, passes through the second flow path 3, and flows to the fluid outlet 6. The remaining chemical flows to the downstream side of the spiral flow path 2. Further, when the part of the denser concentration remaining chemical flows through the location where the branch flow path 4*b* is connected, part of that flows through the branch flow path 4*b*, passes through the second flow path 3, and flows to the fluid outlet 6. The remaining chemical flows to the downstream side of the spiral flow path 2. Further, when the part of the denser concentration remaining chemical flows through the location where the branch flow path 4*c* is connected in the same way as the chemical flowing through the branch flow path 4*b*, part of that flows through the branch flow path 4*c*, passes through the second flow path 3, and flows to the fluid outlet 6. Below, in the same way as in 4*a*, 4*b*, and 4*c*, the part of the denser concentration remaining chemical flows through the 4*d* and 4*e*, passes through the second flow path 3, and flows to the fluid outlet 6.

At this time, part of the denser concentration chemical flowing through the branch flow path 4*a* flows out from the fluid outlet 6 earlier than the other denser concentration chemical. Parts of the denser concentration chemical flow out from the fluid outlet 6 with a time difference in the order of the branch flow path 4*b*, branch flow path 4*c*, branch flow path 4*d*, and branch flow path 4*e*. That is, the partially denser concentration chemical flowing through the flow path is divided into five by the fluid mixer with a time difference. By the non-denser concentration chemical being mixed with them, the fluid can be mixed uniformly in the flow direction. At this time, if the inside diameters of the individual branch flow paths are substantially the same, the part of the denser concentration chemical is divided into substantially five equal parts, so the fluid can be mixed while making the distribution of concentration in the direction of flow uniform without any unevenness.

Note that, in the present embodiment of FIG. 1, the branch flow paths 4*a* to 4*e* are provided so as to be at positions at equal intervals along the axis of the second flow path 3, but to adjust the time difference of the fluid flowing through the branch flow paths 4*a* to 4*e*, it is possible to freely set the positions of connection or to form the spiral flow path 2 to become gradually smaller in flow section area from the one end part connected to the first flow path 1 toward the other end part. The number of the branch flow paths 4*a* to 4*e* is not particularly limited. Provision of a large number of branch flow paths 4*a* to 4*e* enables the distribution of concentration of the fluid in the direction of flow to be made finely uniform without any unevenness.

Figure 2:
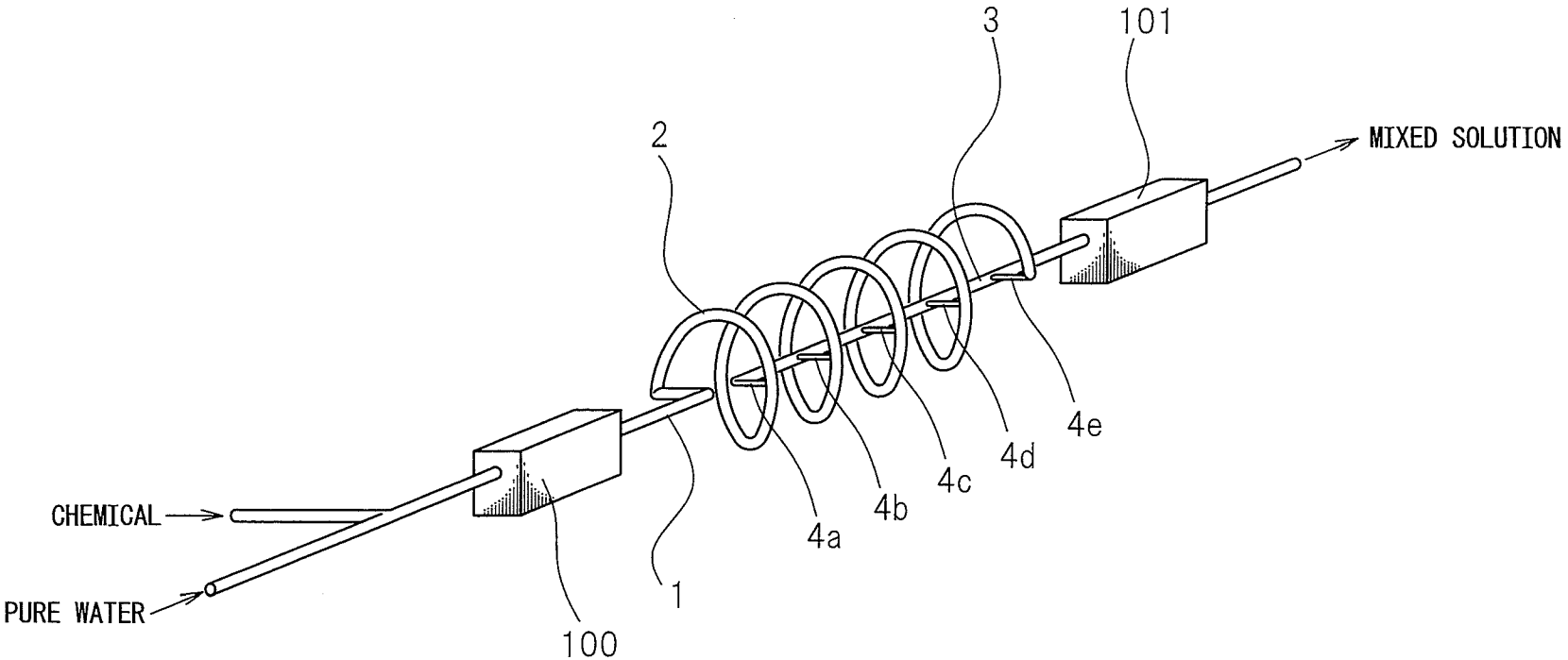
FIG. 2 is a schematic view of an apparatus using the fluid mixer of FIG. 1 for measuring a concentration of fluid.

Here, the action of dividing the part of the denser concentration chemical by the fluid mixer to make distribution of concentration of the fluid in the direction of flow uniform without any unevenness will be explained. As shown in FIG. 2, in a line installing the fluid mixer of FIG. 1 at the downstream side of a merged part of lines through which two substances, that is, pure water and a chemical, flow, concentration meters 100 and 101 are set at the upstream side and downstream side of the fluid mixer of FIG. 1 to create an apparatus for mixing and passing on pure water and a chemical from the upstream side. If instantaneously making the concentration of the chemical denser (increasing the ratio of the chemical with respect to the pure water) in the middle of feeding the pure water and chemical by a certain ratio, then measuring the concentrations at the upstream side and downstream side when feeding the fluid by the original constant ratio and causing unevenness in the distribution of concentration, the results as shown in FIG. 3 and FIG. 4.

Figure 3:
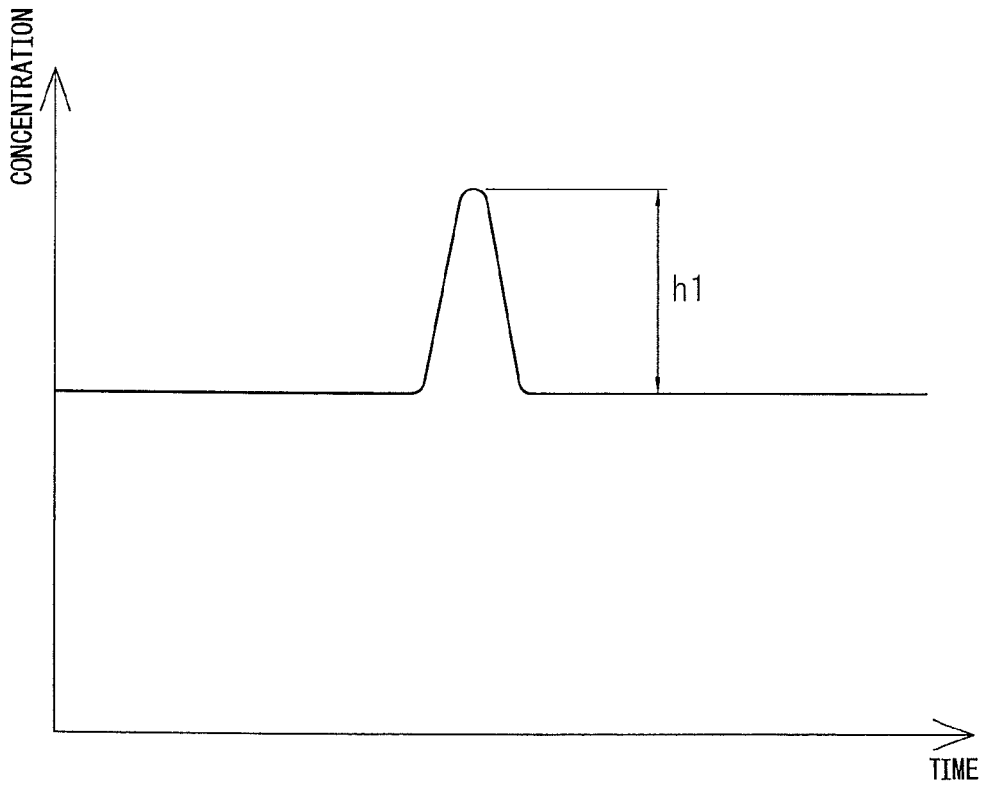
FIG. 3 is a graph for measuring the concentration at an upstream side of the fluid mixer of FIG. 2.
Figure 4:
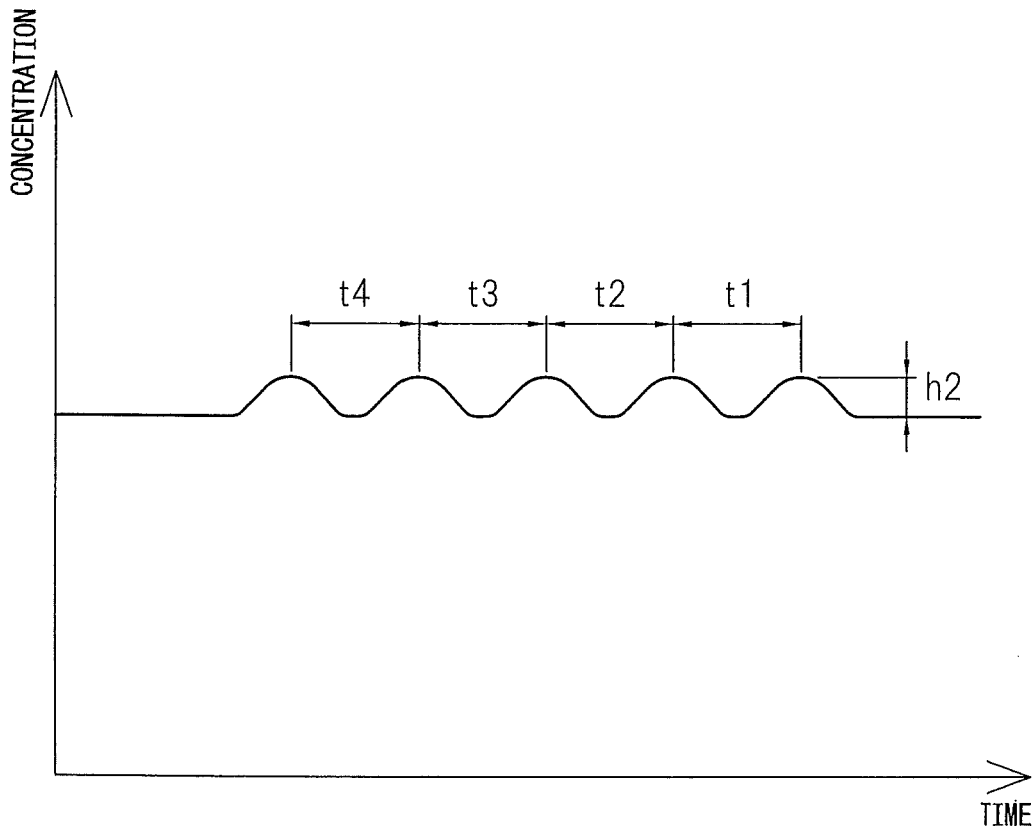
FIG. 4 is a graph for measuring the concentration at a downstream side of the fluid mixer of FIG. 2.

FIG. 3 is a graph of the upstream side of the concentration meter 100 set at the fluid mixer, but here the abscissa shows the elapsed time, while the ordinate shows the concentration. When the concentration becomes denser for a certain time, a peak (h1) such as in the figure appears. FIG. 4 is a graph of a concentration member 101 set at the downstream side of the fluid mixer, but the peak of concentration is dispersed into five. The heights of the peaks (h2) become about one-fifth the previous case. The interval t1 between the peaks of the concentration corresponds to the time from when the fluid passes the position of the branch flow path 4*a* inside the spiral flow path 2 to when it reaches the branch flow path 4*b*. Similarly, t2 corresponds to the time from the branch flow path 4*b* to the branch flow path 4*c*, t3 to the time from the branch flow path 4*c* to the branch flow path 4*d*, and t4 to the time from the branch flow path 4*d* to the branch flow path 4*e*. At this time, by changing the lengths of the spiral flow path 2 to the individual branch flow paths 4*a* to 4*e*, it is possible to change the intervals t1 to t4 at which the peaks (h2) appear. If further increasing the number of branch flow paths 4*a* to 4*e*, the heights of the peaks (h2) can be kept down to heights of an extent of the upstream side peak (h1) divided by the number of branch flow paths. Note that, even if not providing the fluid mixer, the peak of concentration shown in FIG. 3 may fall somewhat due to the flow of the fluid, but the peak (h1) does not change much during the flow.

Note that, in the present embodiment, the unevenness of the distribution of concentration is explained, but a similar effect can be obtained even for making the distribution of temperature when mixing hot water and cold water uniform in the flow direction. For the purpose of making the distribution of temperature uniform, utilization for a hot water heater etc. is also possible. By making the temperature of the fluid, which partially becomes a high temperature in the flow path, uniform in the flow direction, it is possible to stabilize the temperature and prevent burns due to the flow of hot water. Further, by repeatedly branching and combining flow paths of the fluid mixer, the fluid is mixed not only in the flow direction, but also in the diametrical direction. In this embodiment of the present invention, for convenience in the explanation of the action, a "fluid inlet" and "fluid outlet" are described, but similar effects can be obtained even if running the fluid in the opposite direction. In this case, the fluid outlet becomes the inlet into which the fluid flows, while the fluid inlet becomes the outlet from which the fluid flows.

Figure 5:
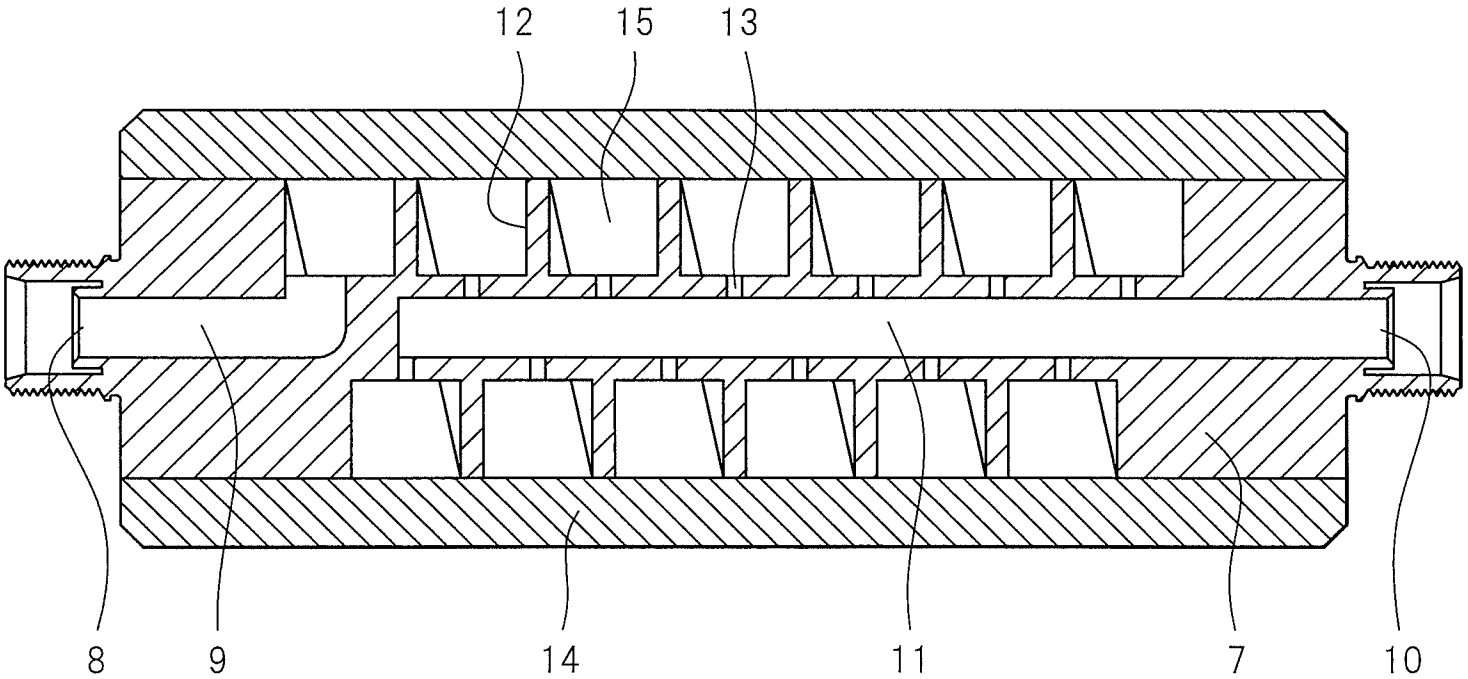
FIG. 5 is a longitudinal cross-sectional view of a fluid mixer of a second embodiment of the present invention.

Next, referring to FIG. 5, the fluid mixer of the second embodiment of the present invention will be explained.

Reference numeral 7 is a PTFE main body part. The main body part 7 is formed into a columnar shape. At one end face of the main body part 7, a fluid inlet 8 and a first flow path 9 connected to the fluid inlet 8 are connected. At the other end face, a fluid outlet 10 and a second flow path 11 connected to the fluid outlet 10 is provided. The first and second flow paths 9 and 11 are arranged at positions on the center axis of the main body part 7. At the outer circumferential surface of the main body part 7, a spiral groove 12 is provided. One end part of the spiral groove 12 is connected to the first flow path 9. Communicating holes 13 forming a plurality of branch flow paths are provided communicating the inner circumferential surface of the second flow path 11 and the bottom surface of the spiral groove 12. Further, the communicating hole 13 positioned at the location nearest the fluid outlet 10 side is communicated with the other end part of the spiral groove 12.

Reference numeral 14 is a cylindrical member forming a PFA tube housing. The cylindrical member 14 is formed into a substantially cylindrical shape. The inside diameter of the cylindrical member 14 is formed to approximately the same diameter as the outside diameter of the main body part 7. By shrink fitting of the main body part 7 and the tube formed by the cylindrical member 14, the member is fit over the outer circumferential surface of the main body part 7 in a sealed state. By fitting the cylindrical member 14 over the main body part 7, a spiral flow path 15 is formed between the spiral groove 12 of the main body part 7 and the inner circumferential surface of the cylindrical member 14.

Figure 6:
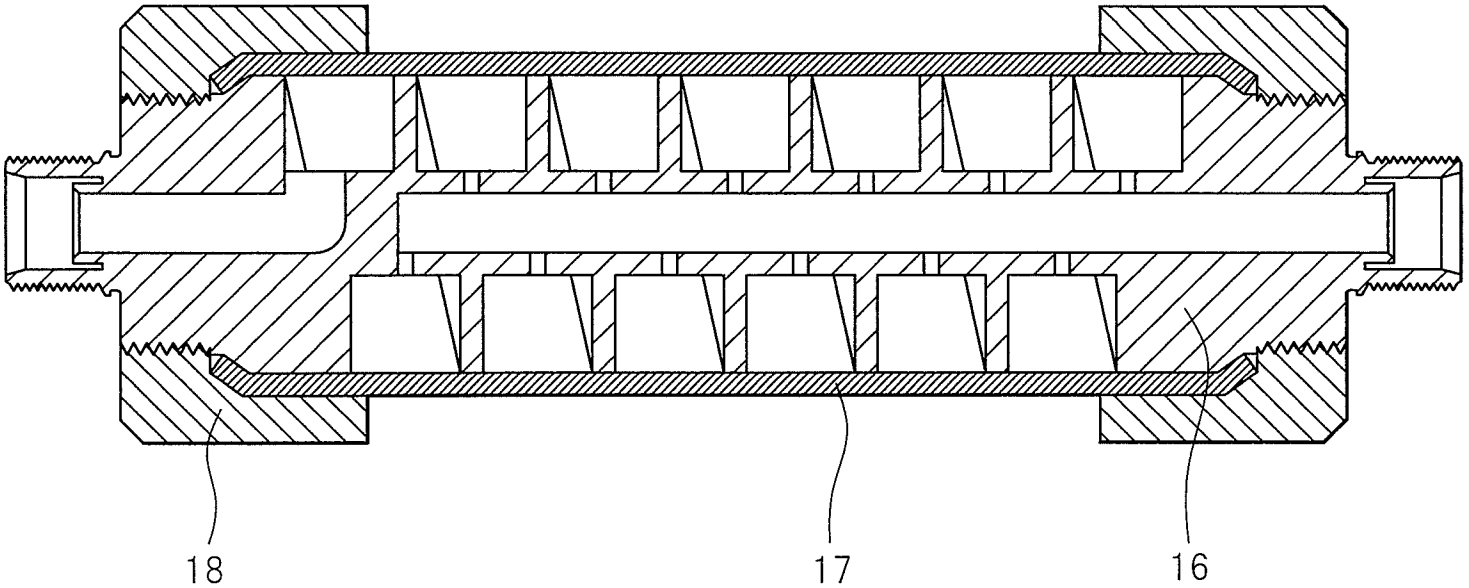
FIG. 6 is a longitudinal cross-sectional view of a different attachment structure of a cylindrical member in the second embodiment.
Figure 7:
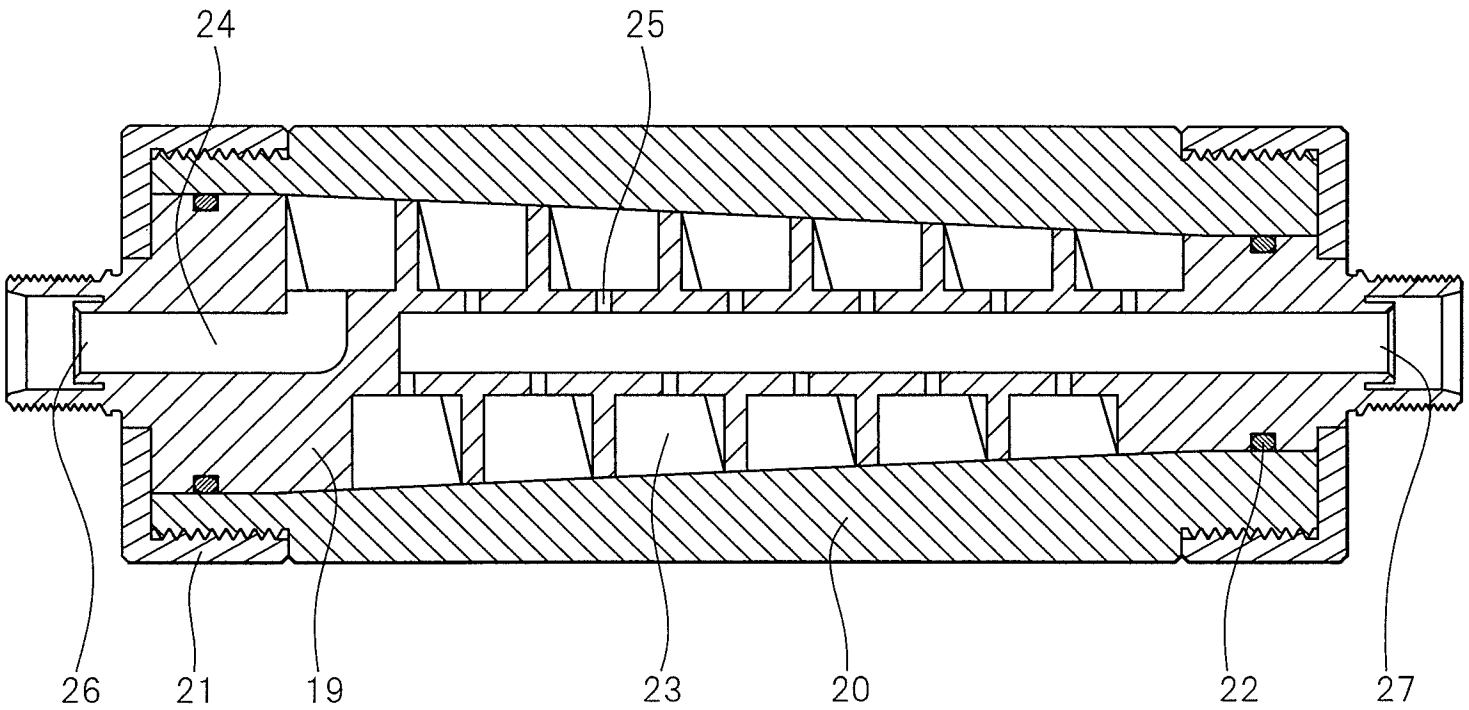
FIG. 7 is a longitudinal cross-sectional view of a different structure of a spiral flow path in the second embodiment.

Note that, the housing, that is, the cylindrical member 14, may be formed by a hard member in addition to a soft member such as a tube. The housing may be shaped as a box member in addition to a cylindrical member. Further, the cylindrical member 14 and the main body part 7 may be fit together by any method so long as fit together in a sealed state. In addition to shrink fitting, welding or bonding are also possible. As shown in FIG. 6, it is also possible to fit the PFA tube cylindrical member 17 closely over the main body part 16 and screw cap nuts 18 over the two ends of the main body part 16 so as to fasten the cylindrical member 17 over the outer circumferential surface of the main body part 16 in a sealed state or, as shown in FIG. 7, it is also possible to fit a substantially tubular shaped cylindrical member 20 over the main body part 19 and use cap nuts 21 to fasten the cylindrical member 20 in a state sealed by seal rings 22 with the outer circumferential surface of the main body part 19.

Next, the action of the fluid mixer of the second embodiment of the present invention will be explained.

From the upstream side of the fluid mixer, the water and chemical are mixed and flow in a state with the concentration of the chemical temporarily made denser. At that time, the partially denser concentration chemical flowing through the flow path flows in from the fluid inlet 8 and flows to the spiral flow path 15. The partially denser concentration chemical flowing through the spiral flow path 15 is divided by the communicating holes 13. The partially denser concentration chemical flows through the second flow path 11 with a time difference, mixes with the non-denser concentration chemical, and thereby enables mixing uniform in the flow direction of the fluid. The action by which the distribution of concentration of the fluid in the direction of flow is made uniform without any unevenness of the second embodiment is similar to that of the first embodiment, so the explanation will be omitted. In the fluid mixer of the present embodiment, the communicating holes 13 which communicate the inner circumferential surface of the second flow path 11 and the bottom surface of the spiral groove 12 can be easily formed, so it is possible to freely determine the positions of provision and number of provision of the communicating holes 13, possible to finely and evenly adjust the offset times of flow, and possible to more finely make the distribution of concentration of the fluid in the direction of flow uniform without any unevenness. Further, in the fluid mixer of the present embodiment, while the flow path is complicated, the work involved is relatively easy and the number of parts is also small, so production is easy. Further, the structure of the flow path is kept small, so the fluid mixer can be made small in size and can be installed without taking up piping space. Further, even when connecting the fluid mixer to a pipeline, installation is completed by just connecting couplings to the fluid inlet 8 and the fluid outlet 10, so the piping work is easy and can be performed in a short time.

Here, the communicating holes 13 are preferably formed to be approximately identical in flow section areas. This is preferable since if the flow rates of the fluid divided by the communicating holes 13 are constant, the fluid flowing into the fluid mixer will be divided substantially equally by the number of communicating holes 13 and will flow while merging with respective time difference, so the distribution of concentration can be made uniform without any unevenness.

Further, as shown in FIG. 7, the spiral flow path 23 is preferably formed so as to become gradually smaller in flow section area from the one end part connected with the first flow path 24 toward the other end part. This is preferable since the fluid flowing through the spiral flow path 23 experiences a pressure loss due to fluid being divided off and flowing from the communicating holes 25 and the flow rate at the downstream side of the spiral flow path 23 falls, so by making the spiral flow path 23 gradually smaller in flow section area, it is possible to make the fluid flow by a constant rate even if pressure loss occurs and to stabilize the time difference of the flow of the fluid divided off. Note that, as the method of reducing the flow section area of the spiral flow path 23, as shown in FIG. 7, it is possible to provide the main body part 19 to gradually be reduced in diameter of its outer circumferential surface from the fluid inlet 26 toward the fluid outlet 27 and fit a cylindrical member 20 matched with the outer circumferential surface shape so as to form a spiral flow path 23 or, in addition, form the spiral groove to become gradually shallower in depth (not shown), form the spiral groove to become gradually narrower in width (not shown), or to form it by a combination of these.

Figure 8:
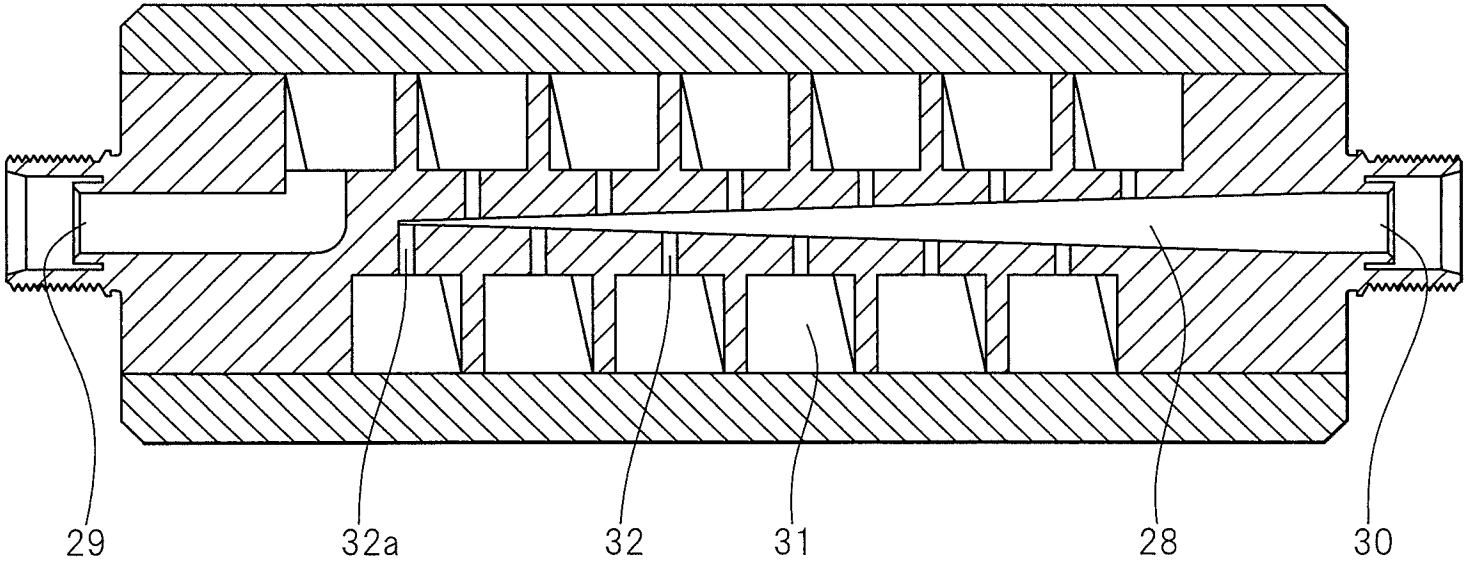
FIG. 8 is a longitudinal cross-sectional view of a different structure of a second flow path in the second embodiment.

Further, as shown in FIG. 8, preferably the inner circumferential surface of the second flow path 28 is formed to gradually expand in diameter from the upstream part (fluid inlet 29 side) to the fluid outlet 30. This is preferable so as to make the fluid flowing through the spiral flow path 31 first divided off and flowing from the communicating hole 32*a* to the second flow path 28 flow through the second flow path 28 and flow out from the fluid outlet 30 the fastest, then gradually slow the flow rates of fluid successively divided off and flowing from the communicating holes 32 through the second flow path 28 so as to better clarify the time differences of the flowing fluid.

Next, referring to FIG. 9, a fluid mixer of a third embodiment of the present invention will be explained.

The fluid mixer is provided with a fluid outlet 46 from which the fluid flows out, a second flow path 43 connected to the fluid outlet 46, and a spiral flow path 42 having the second flow path 43 as the center axis of the spiral. A fluid inlet 45 into which the fluid flows and a first flow path 41 connected to the fluid inlet 45 are provided connected with one end part of the spiral flow path 42 at the fluid outlet side. In the middle of the spiral flow path 42, five branch flow paths 44*a* to 44*e* are provided connected with the second flow path 43. Further, the branch flow path 443 positioned at the location furthest from the fluid outlet 46 side is provided connected to the other end part of the spiral flow path 42. In this embodiment, for example, tubes etc. may be used for pipe connections.

Next, the action of the fluid mixer of the third embodiment of the present invention will be explained.

From the upstream side of the fluid mixer, the water and chemical are mixed and flow in a state with the concentration of the chemical temporarily made denser. At that time, the partially denser concentration chemical flowing through the flow path flows from the fluid inlet 45 to the first flow path 41 and flows through the spiral flow path 42. When the denser concentration chemical flows through the location of the spiral flow path 42 connected to the branch flow path 44*a*, part of that flows through the branch flow path 44*a*, passes through the second flow path 43, and flows to the fluid outlet 46. The remaining chemical flows to the downstream side of the spiral flow path 42. Further, when the denser concentration remaining chemical flows to the location connected to the branch flow path 44*b*, part of that flows through the branch flow path 44*b*, passes through the second flow path 43, and flows to the fluid outlet 46. The remaining chemical flows to the downstream side of the spiral flow path 42. Further, when the part of the denser concentration remaining chemical, in the same way as the chemical flowing through the branch flow path 44*b*, flows through the location connected to the branch flow path 44*c*, part of that flows through the branch flow path 44*c*, passes through the second flow path 43, and flows to the fluid outlet 46. Below, in the same way as 44*a*, 44*b*, and 44*c*, the part of the denser concentration remaining chemical flows through 44*d* and 44*e*, passes through the second flow path 43, and flows out to the fluid outlet 46.

At this time, part of the denser concentration chemical flowing through the branch flow path 44*a* passes through the second flow path 49 by the shortest route and flows out from the fluid outlet 48 faster than the other denser concentration chemical. At offset times, parts of denser concentration chemical running over routes gradually becoming longer flow out in the order of the branch flow path 44*b*, branch flow path 44*c*, branch flow path 44*d*, and branch flow path 44*e*. That is, the partially denser concentration chemical flowing through the flow path fluid is divided into five parts by the mixer. By the non-denser concentration chemical being mixed with them, the fluid can be mixed uniformly in the flow direction. In particular, since the distance from the branch flow paths 44*a* to 44*e* to the fluid outlet 46 becomes longer by each constant distance in the order of division, it is possible to make the time difference clearer.

Figure 9:
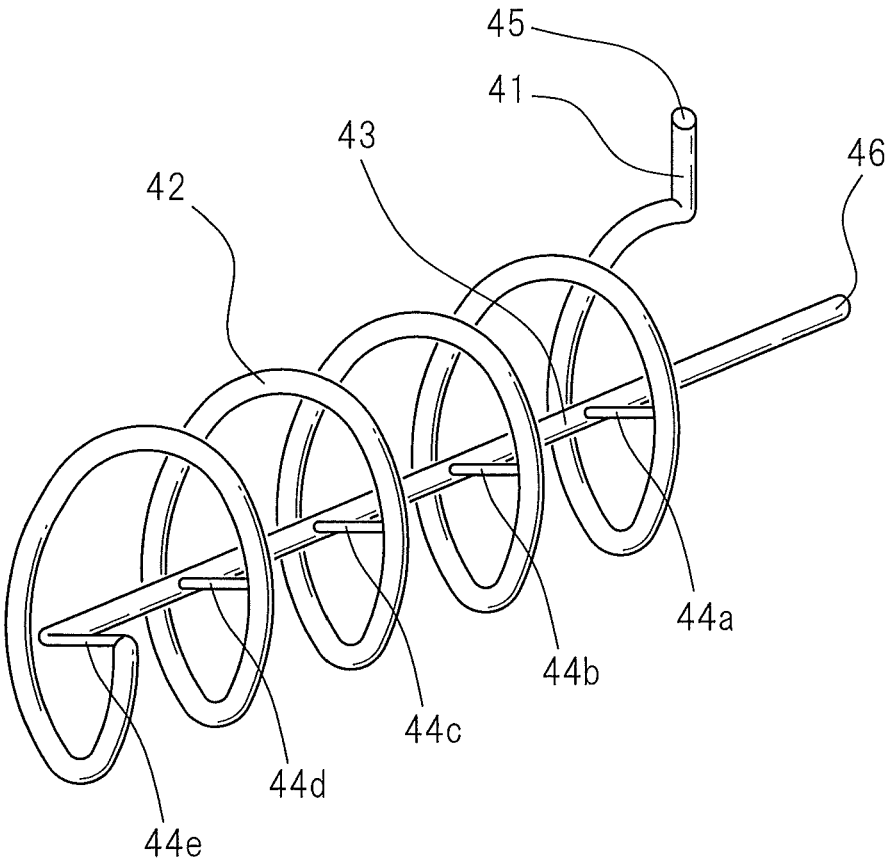
FIG. 9 is a schematic view of a pipe flow path showing a fluid mixer of a third embodiment of the present invention.

Note that, the branch flow paths 44*a* to 44*e* of FIG. 9 are provided so as to be positioned at equal intervals along the axis of the second flow path 43, but to adjust the time difference of the fluid flowing through the branch flow paths 44*a* to 44*e*, it is possible to freely set the positions of connection to the second flow path 43 or to form the spiral flow path 42 to become gradually smaller in flow section area from the one end part connected to the first flow path 41 toward the other end part. The number of the branch flow paths 44*a* to 44*e* is not particularly limited. Provision of a large number of branch flow paths 44*a* to 44*e* enables the distribution of concentration of the fluid in the direction of flow to be made finely uniform without any unevenness.

Figure 10:
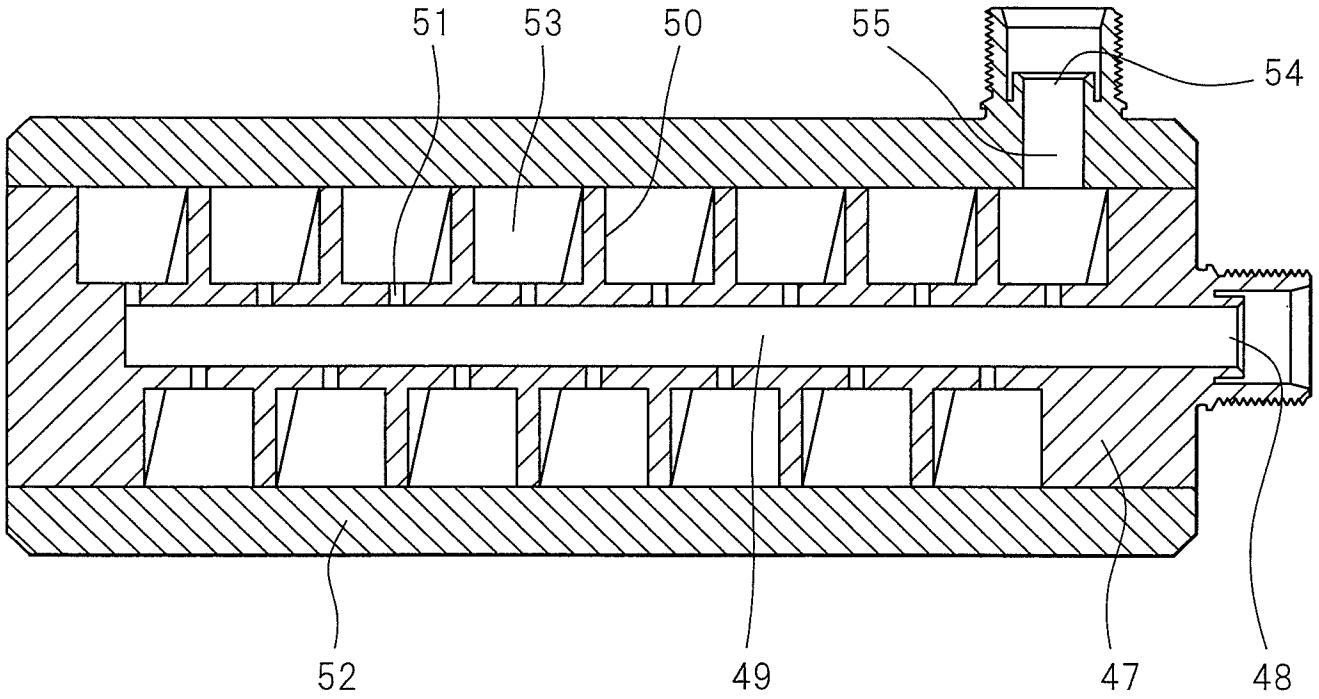
FIG. 10 is a longitudinal cross-sectional view of a fluid mixer of a fourth embodiment of the present invention.

Next, referring to FIG. 10, a fluid mixer of a fourth embodiment of the present invention will be explained.

Reference numeral 47 is a polytetrafluoroethylene main body part. The main body part 47 is formed into a columnar shape. At one end face of the main body part 47, a fluid outlet 48 and a second flow path 49 connected with the fluid outlet 48 is provided. The second flow path 49 is arranged at a position on the center axis of the main body part 47. At the outer circumferential surface of the main body part 47, a spiral groove 50 is provided. At one end part of the spiral groove 50 at the fluid outlet 48 side, the later mentioned first flow path 55 is connected. Communicating holes 51 are provided forming a plurality of branch flow paths communicating the inner circumferential surface of the second flow path 49 and the bottom surface of the spiral groove 50. Further, the communicating hole 51 positioned at the location farthest from the fluid outlet 48 side communicates with the other end part of the spiral groove 50.

Figure 11:
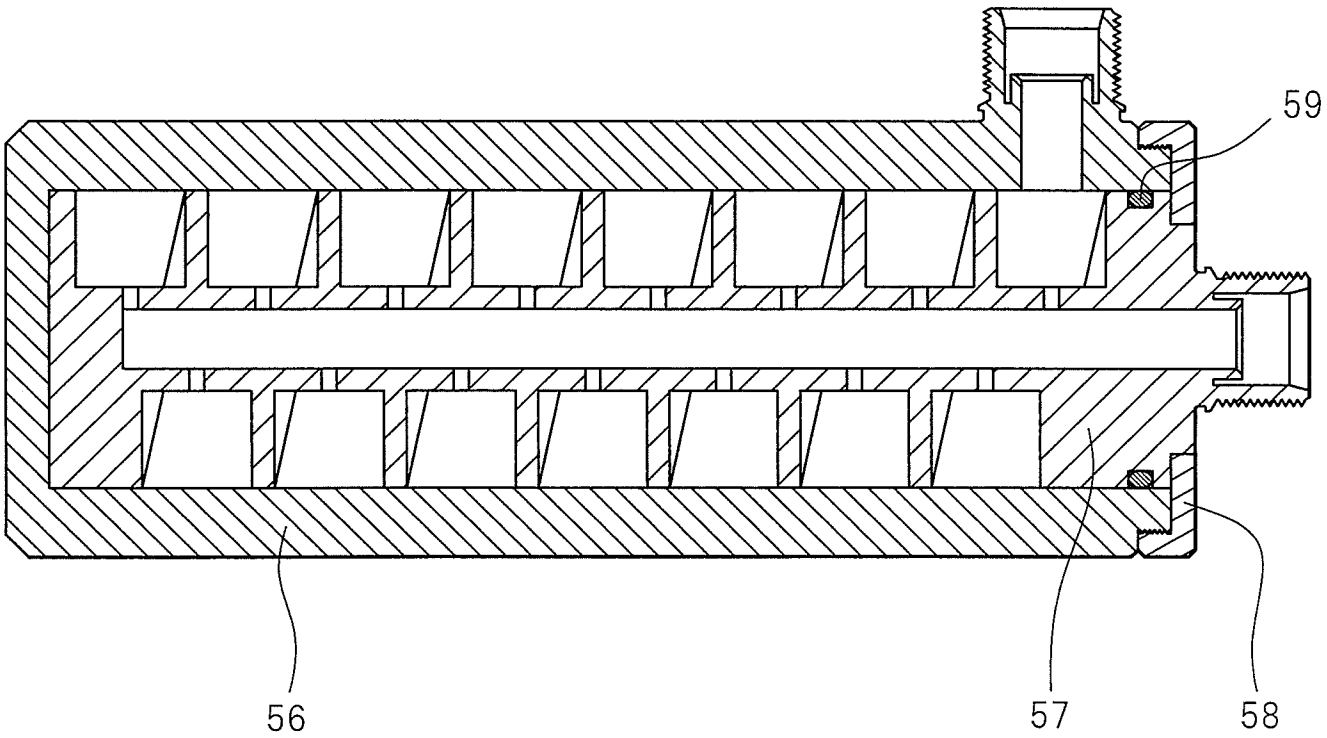
FIG. 11 is a longitudinal cross-sectional view of a different attachment structure of a cylindrical member in the fourth embodiment.

Reference numeral 52 is a cylindrical member forming a polypropylene housing. The cylindrical member 52 is formed into a substantial cylindrical shape. The inside diameter of the cylindrical member 52 is formed to about the same diameter as the outside diameter of the main body part 47. By being shrink fit by the main body part 7, this is fit in a state sealed with the outer circumferential surface of the main body part 47. By fitting the cylindrical member 52 with the main body part 47, the spiral groove 50 of the main body part 47 and the inner circumferential surface of the cylindrical member 52 form the spiral flow path 53. At the side surface of the cylindrical member 52 at the fluid outlet 48 side, a fluid inlet 54 is provided. A first flow path 55 is provided connecting the fluid inlet 54 and one end of the spiral groove 50 of the main body part 47 at the fluid outlet 48 side. Note that, the cylindrical member 52 may be fitted over the main body part 47 by any method so long as it is fitted in a sealed state. In addition to the variations described in the second embodiment, as shown in FIG. 11, it is also possible to fit a closed-bottom cylindrical shape cylindrical member 56 over the main body part 57 and use a cap nut 58 to fasten the cylindrical member 56 in a state sealed by a seal ring 59 with the outer circumferential surface of the main body part 57.

The fourth embodiment is similar to the second embodiment in its action of making the distribution of concentration of the fluid in the flow direction uniform without any unevenness, so the explanation will be omitted. In the same way as the second embodiment, the communicating holes 51 are preferably formed so that the flow section areas become substantially identical. The spiral flow path 53 is preferably formed the flow section area gradually becomes smaller from one end connected with the first flow path 55 toward the other end side. Preferably, the inner circumferential surface of the second flow path 49 is formed to gradually expand in diameter from the upstream part toward the fluid outlet 48.

Figure 12:
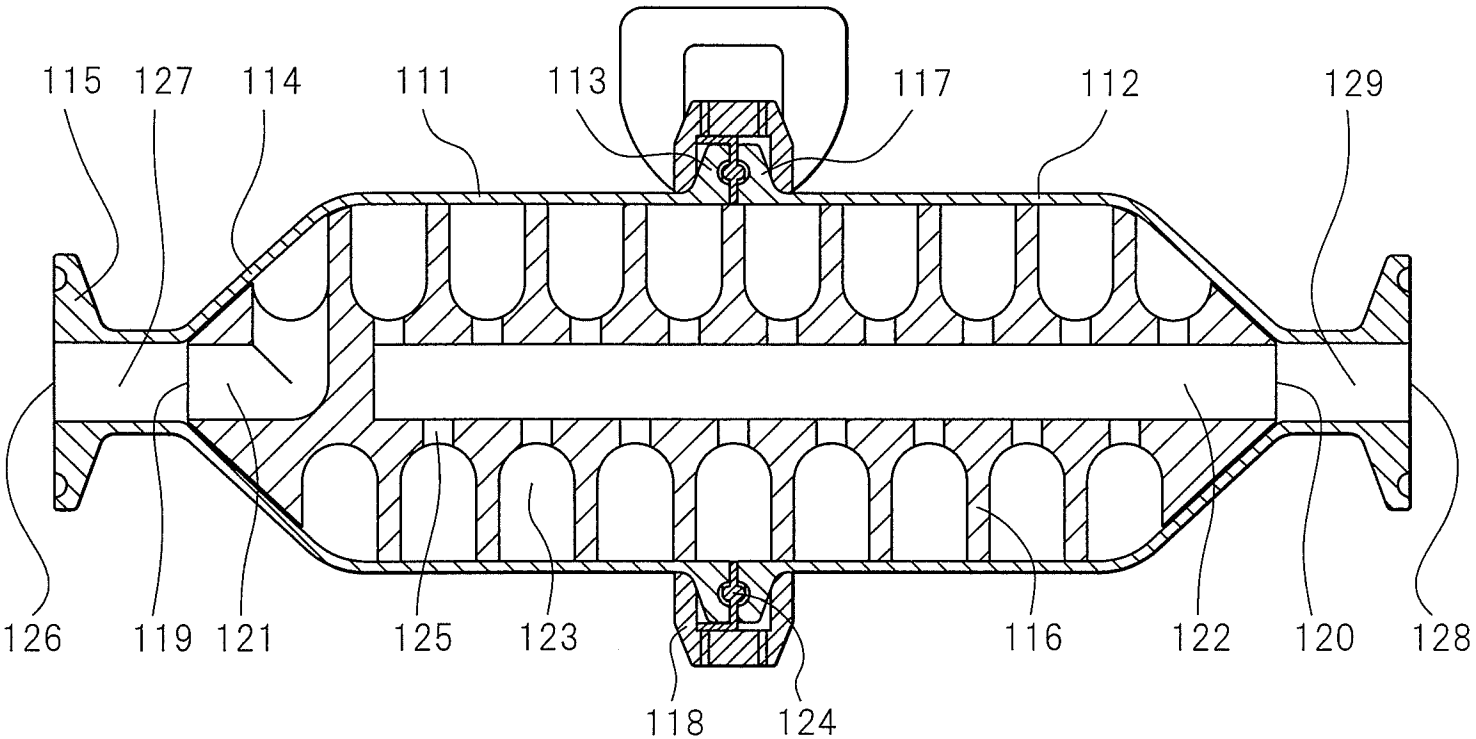
FIG. 12 is a longitudinal cross-sectional view of a fluid mixer of a fifth embodiment of the present invention.

Next, referring to FIG. 12, the fluid mixer of shape using a ferrule coupling of a fifth embodiment of the present invention will be explained.

Reference numerals 111 and 112 are SUS304 first and second cylindrical parts. The first and second cylindrical parts are the same shapes, so the explanation will be given relating to the first cylindrical part 111. At the outer circumference of one end part of the first cylindrical part 111, a flange part 113 is provided. The other end part is provided with a reduced diameter part 114 where the cylindrical part is reduced in diameter and, at the reduced diameter end part of the reduced diameter part 114, a ferrule coupling part 115. At the end face of the flange part 115, an inlet opening 126 is provided. An inlet flow path 127 communicating with the inlet opening and the first cylindrical part 111 (in the second cylindrical part 112, the inlet parts are the outlet opening 128 and outlet flow path 129) is provided.

Reference numeral 116 is an SUS304 main body part. The main body part 116 is formed in a columnar shape. At one end face of the main body part 116, a fluid inlet 119 and a first flow path 121 connected to the fluid inlet 119 are provided, while at the other end face, a fluid outlet 120 and a second flow path 122 connected to the fluid outlet 120 are provided. The first and second flow paths 121 and 122 are arranged at positions at the center axis of the main body part 116. At the outer circumferential surface of the main body part 116, a spiral groove 123 is provided. At one end of the spiral groove 123, the first flow path 121 is connected. Communicating holes 125 forming a plurality of branch flow paths communicating the inner circumferential surface of the second flow path 122 and the bottom surface of the spiral groove 123 are provided. Further, the communicating hole 125 positioned at the location nearest to the fluid outlet 120 side is communicated with the other end part of the spiral groove 123. The two end parts of the main body part 116 are reduced in diameters to shapes matching the inner circumferential surfaces of the first and second cylindrical parts 111 and 112. The outer circumferences are formed to approximately the same diameters as the first and second cylindrical parts 111 and 112. The main body part 116 is inserted into the opening parts of the flange parts 113 and 117 of the sides of the first and second cylindrical parts 111 and 112 not reduced in diameter. Between the end faces of the flange parts 113 and 117, a gasket 124 is provided. The flange parts 113 and 117 are fastened by a clamp 118. The inlet flow path 127 of the first cylindrical part 111 is communicated with the first flow path 121 of the main body part 116, while the outlet flow path 129 of the second cylindrical part 112 is communicated with the second flow path 122 of the main body part 116. At this time, the first and second cylindrical parts 111 and 112 form a housing.

Note that, the flange parts 113 and 117 of the present embodiment are connected in the same way as the method of connection of a ferrule coupling. A ferrule coupling may also be used. Even with a shape other than the present embodiment, a ferrule coupling can be used for facilitating assembly for forming a fluid mixer. For example, it is also possible to fit the main body part in a housing provided with ferrule coupling parts at the two end parts of a cylindrical shape housing. Further, the flow path of the main body part may be made the same shape as the fourth embodiment. In this case, the closed-bottom cylindrical shape first cylindrical part and the second cylindrical part provided with the fluid inlet and fluid outlet are connected by a ferrule coupling part (not shown).

Next, the action of the fifth embodiment will be explained. The fluid flowing into the fluid mixer runs from the fluid inlet 119 through the first flow path 121 of the main body part 116 and flows into the spiral flow path which the spiral groove 123 forms. The action of making the distribution of concentration of the fluid in the direction of flow of the fluid uniform without any unevenness by flowing through the flow path in the main body part 116 is similar to that of the first embodiment, so the explanation will be omitted. The uniform fluid passes through the second flow path 122 and flows out from the fluid outlet 120. At this time, the fluid mixer of the present embodiment is easy to disassemble and assemble. The ferrule coupling part 115 facilitates attachment to and detachment from a pipeline. In particular, this can be preferably used in the food field where the work of disassembly, washing the parts, then reassembling them is frequently performed.

Figure 13:
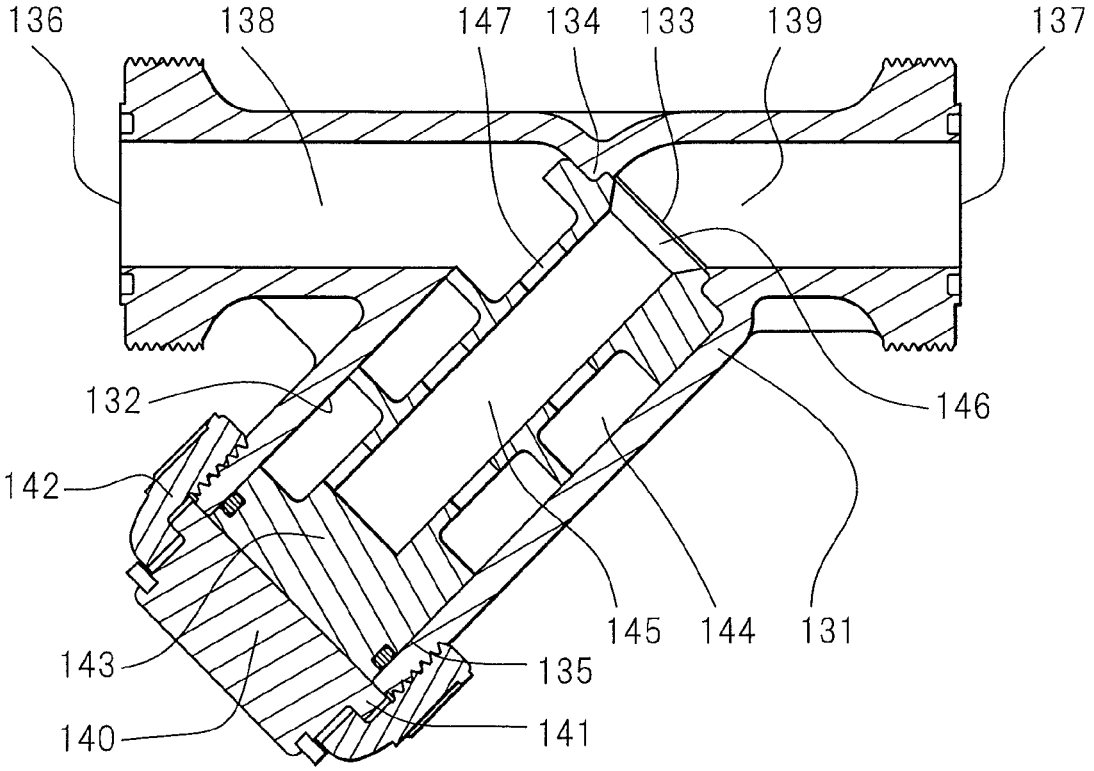
FIG. 13 is a longitudinal cross-sectional view of a fluid mixer of a sixth embodiment of the present invention.

Next, referring to FIG. 13, a Y-type strainer shaped fluid mixer of a sixth embodiment of the present invention will be explained.

In the figure, 131 is a polyvinyl chloride (below, indicated as "PVC") body. This is formed into a Y-shaped pipe. At the bottom part of the body 131, a hollow chamber 132 is provided. The body has a seat 134 having a communicating hole 133 communicating with the hollow chamber 132 and an opening part 135 opening downward from the hollow chamber 132. At the two end faces of the body 131, a flange shaped inlet opening 136 and outlet opening 137 are formed. The body further has an inlet flow path 138 communicating with the inlet opening 136 and the hollow chamber 132 and an outlet flow path 139 communicating with the outlet opening 137 and the communicating hole 133.

Reference numeral 140 is a PVC lid member. It is formed into a disk shape. At the outer circumference of one end part, a flange part 141 is provided.

The PVC cap nut 142 is formed into a cylindrical shape. At the inner circumference of one end part, a female thread is provided which can be screwed with a male thread provided at the outer circumference of the opening part 136 of the body 131. At the other end part, an inside flange sticking out in the inner circumferential direction is provided. The cap nut 142 abuts against the end face of the flange part 141 of the lid member 140 at its inner flange part and is screwed with the male thread of the body 131 so as to thereby fasten the lid member 140. This body 131 and lid member 140 form the housing. Note that, the lid member 140 and the later mentioned main body part 143 may be integrally provided. Further, it is also possible to not use the cap nut 142, but to form a female thread on the lid member 140 and screw it to the body 131. It is also possible to provide the opening part 135 of the body 131 with a female thread and screw a lid member 140 having a male thread over it. Further, the method of fastening is not particularly limited so long as being able to fasten the body 131 and the lid member 140 and may be a bayonet, ferrule, screw, or other type in addition to screwing.

Reference numeral 143 is a PVC main body part. The main body part 143 is formed in a columnar shape. At one end face of the main body part 143, a fluid outlet 146 and a second flow path 145 connected to the fluid outlet 146 are provided. The second flow path 145 is arranged at the position of the center axis of the main body part 143. At the outer circumferential surface of the main body part 143, a spiral groove 144 is provided. One end part of the spiral groove 144 at the fluid outlet 146 is communicated with an inlet flow path 138 of the body 131. Communicating holes 147 forming a plurality of branch flow paths are provided communicating the inner circumferential surface of the second flow path 145 and the bottom surface of the spiral groove 144. Further, the communicating hole 147 positioned at the location furthest from the fluid outlet 146 side communicates with the other end part of the spiral groove 144. The outer circumference of the main body part 143 is formed to substantially the same diameter as the inner circumference of the hollow chamber 132 of the body 131. At the outer circumference of the end part of the main body part 143 at the opposite side to the fluid outlet 146, a ring-shaped groove having an O-ring which is sealed with the inner circumferential surface of the opening part 135 is provided. The main body part 143 is fit from the opening part 135 of the body 131 into the hollow chamber 132, the end part of the inserted main body part 143 is made to abut against the seat 134 to make the second flow path 145 of the main body part 143 communicate with the communicating hole 133, and in that state is fastened by the lid member 140 and the cap nut 142. At this time, the inlet opening 136 becomes the fluid inlet of the fluid mixer, while the inlet flow path 138 becomes the first flow path of the fluid mixer.

Next, the action of the sixth embodiment will be explained.

The fluid flowing into the fluid mixer runs from the inlet opening 136 of the body 131 through the inlet flow path 138 into the spiral flow path formed by the spiral groove 144 of the main body part 143. The action of flowing through the flow path in the main body part 143 and thereby the distribution of concentration of the fluid in the direction of flow being made uniform without any unevenness is similar to that of the third embodiment, so the explanation will be omitted. The now uniform fluid runs from the second flow path 145 through the outlet flow path 139 and flows out from the outlet opening 137. At this time, the fluid mixer of the present embodiment is easy to disassemble and reassemble. In particular, the invention can be preferably used in the food field where the work of disassembly, washing the parts, then reassembling them is frequently performed.

Next, the apparatus using a fluid mixer of the present invention will be explained.

As the apparatus using a fluid mixer of the present invention, first, there is an apparatus in which a fluid mixer is installed in a line in which the temperature or concentration of the flowing substance changes along with time. This runs the fluid through the fluid mixer to enable the temperature or concentration of the fluid to be made uniform when for example a heater is set in the line, the temperature of the fluid heated by the heater fluctuates with respect to the time axis and thereby the temperature of the flowing fluid changes over time (not shown), when a solid substance stored in a tank is dissolved out into a fluid and the dissolved concentration changes over time in the line through which the fluid flows (not shown), etc. At this time, the substance which flows as a fluid is not limited so long as being a gas or liquid.

Figure 14:
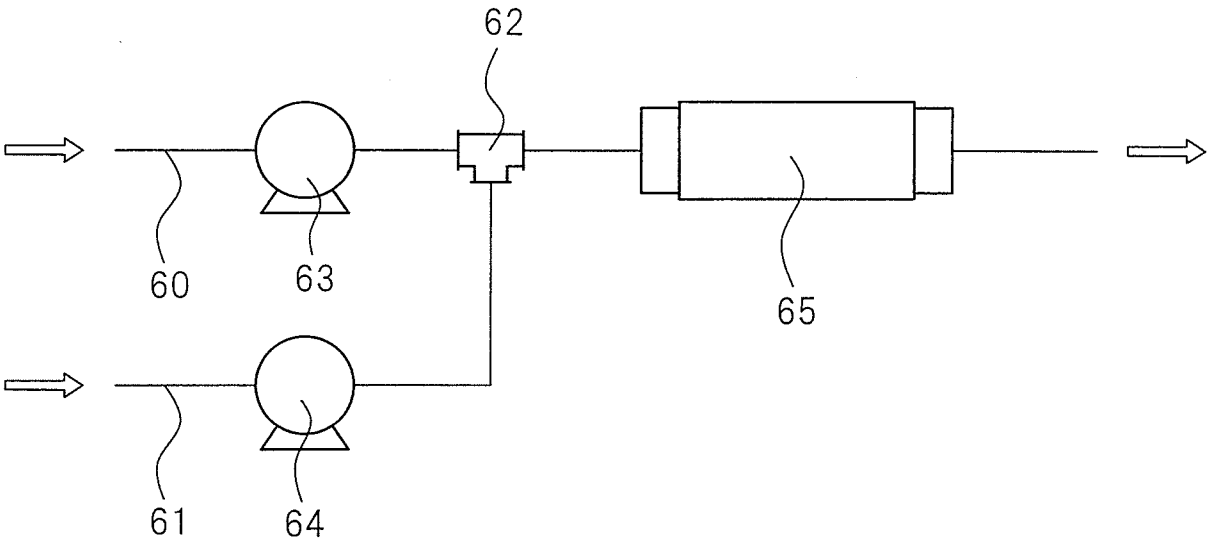
FIG. 14 is a schematic view of an embodiment of an apparatus using the fluid mixer of the present invention.

Further, as shown in FIG. 14, there is an apparatus provided with the fluid mixer of the present invention at the downstream side of a merging part 62 of lines 60 and 61 through which two substances flow. This apparatus uses the fluid mixer 65 to make the mixing ratio of the substances uniform and thereby achieve a uniform temperature or concentration with respect to the time axis when the mixing ratio changes along with time when for example pumps 63 and 64 feeding two substances pulsate, when, in a line where a high temperature fluid and a low temperature fluid merge, the high temperature fluid flows unevenly, fluctuation occurs in the temperature of the fluid with respect to the time axis, and thereby the temperature of the flowing fluid changes over time, when, in a line where a known concentration of fluid is mixed with pristine fluid, the concentration of the mixed fluid changes over time, etc. The substance run as a fluid at this time may be any of a gas, liquid, solid, or powder. The solid or powder has to be able to be run through a line. It may be mixed with a gas or liquid in advance. Note that, it is also possible to make the apparatus one in which lines through which three or more substances flow are merged and in which three or more substances are thereby mixed by the fluid mixer.

Figure 15:
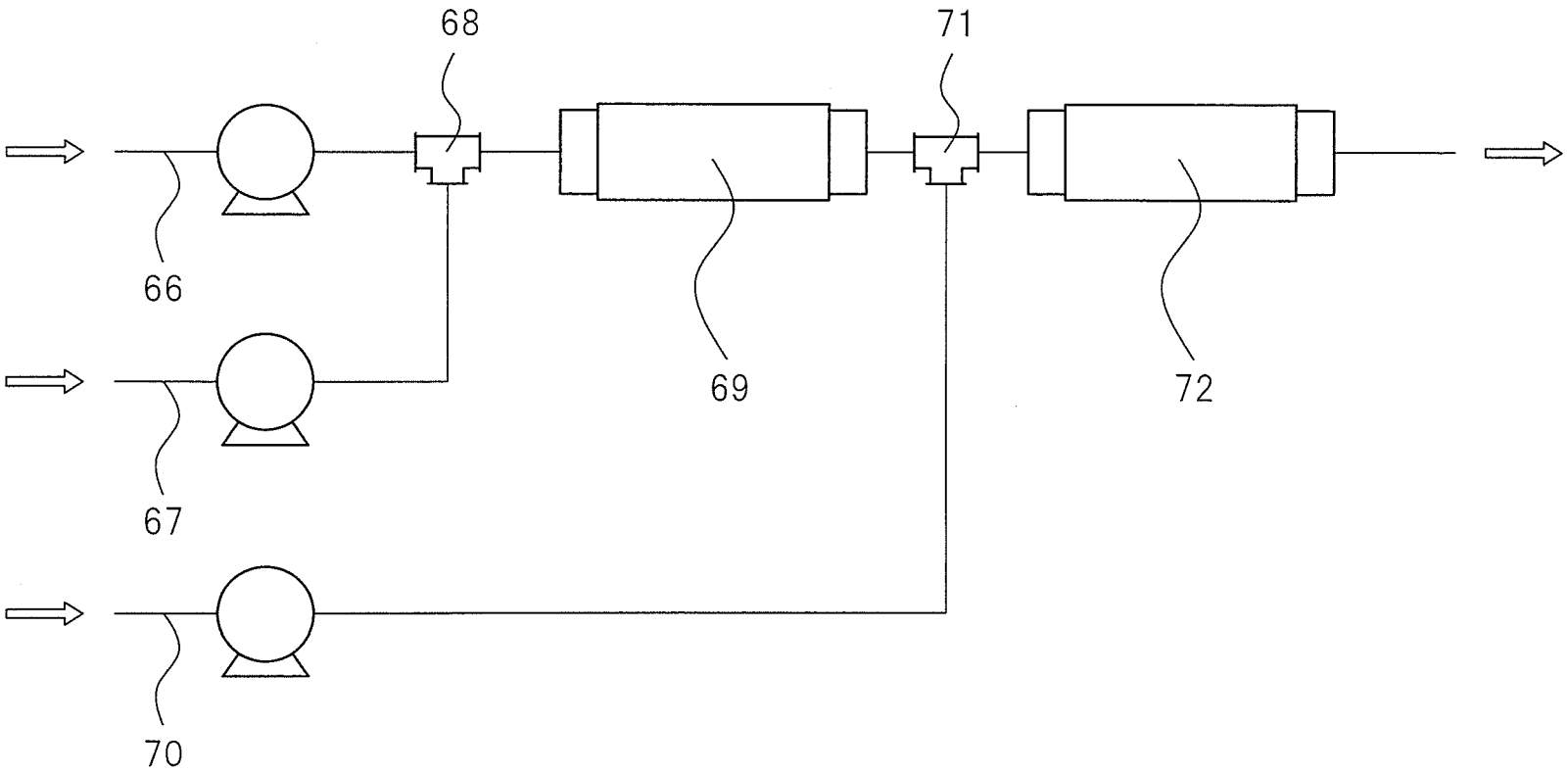
FIG. 15 is a schematic view of another embodiment of an apparatus using the fluid mixer of the present invention.
Figure 16:
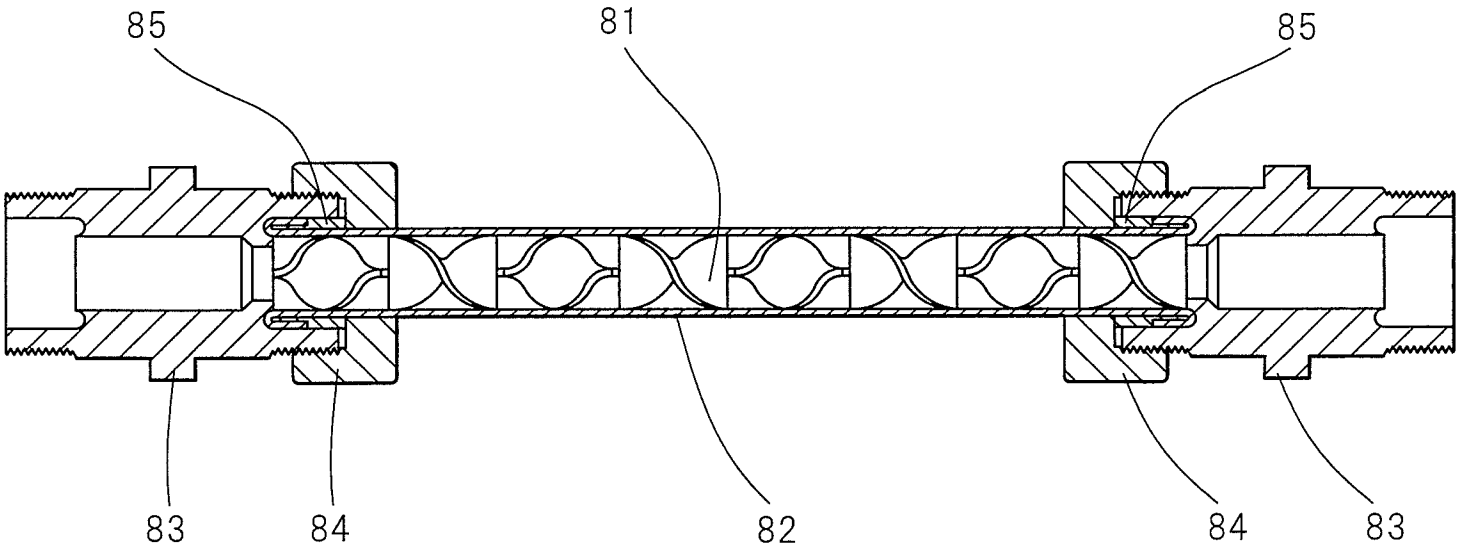
FIG. 16 is a longitudinal cross-sectional view of a conventional static mixer.
Figure 17:
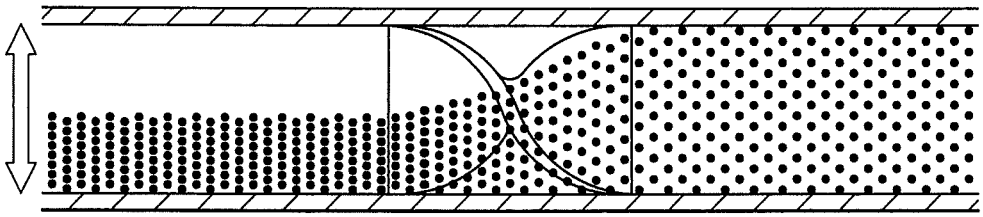
FIG. 17 is a schematic view of a state of agitation of fluid of the static mixer of FIG. 16.
Figure 17:
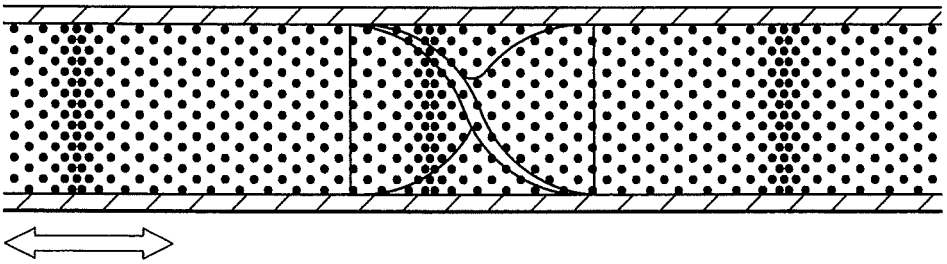
Figure 18:
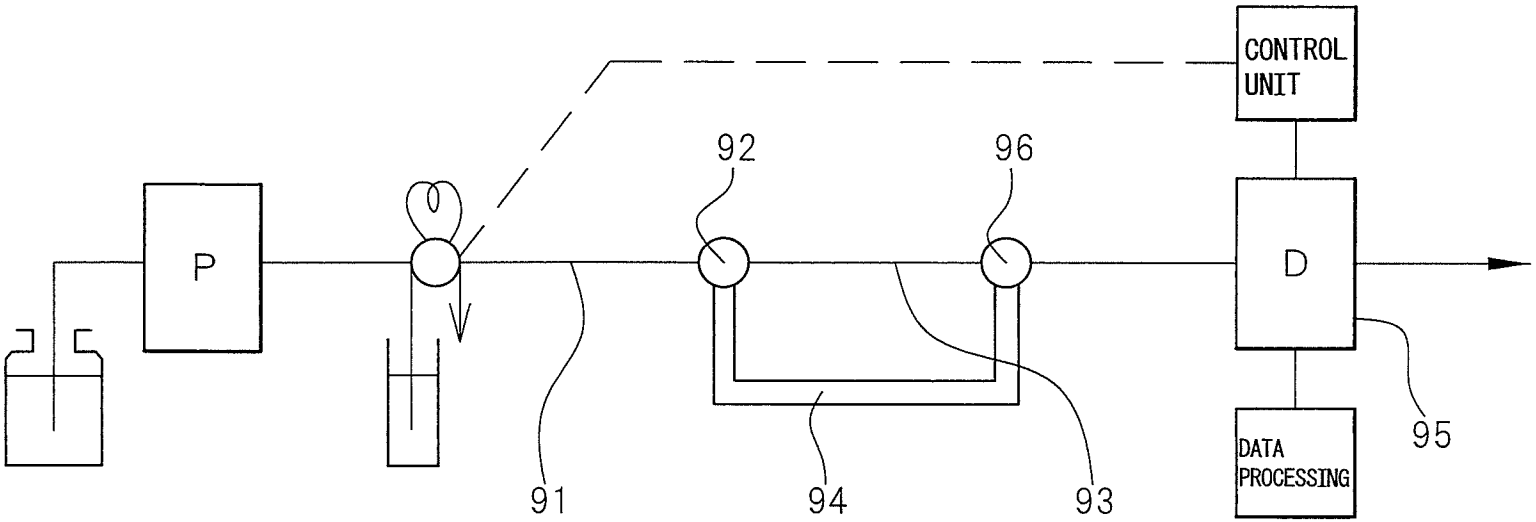
FIG. 18 is a longitudinal cross-sectional view of a conventional branching and diluting device.

Further, as shown in FIG. 15, it is also possible to arrange the fluid mixer 69 of the present invention at the downstream side of the merging part 68 of the lines 66 and 67 through which the two substances flow and to arrange another fluid mixer 72 at the downstream side of the merging part 71 where a line 70 through which another substance flows merges at the downstream side of the fluid mixer 69. When simultaneously mixing three or more substances and uneven mixing would result etc., this makes it possible to make the two first mixed substances to be made uniform, then the other substances to be mixed to be made uniform and thereby enable efficient uniform mixing with no unevenness. For example, when mixing water, oil, and a surfactant, if mixing everything all at once, they will not be mixed well and uneven mixing will occur, so it is possible to mix the water and surfactant in advance, then mix the result with the oil so as to enable uniform mixture with no unevenness; to mix the water and sulfuric acid for dilution, then mix the mixture with ammonia gas for absorption of the ammonia gas; to mix the water and sulfuric acid for dilution, then mix the mixture with sodium silicate and adjust the pH, etc. for the most suitable mixing operation. Note that, it is also possible to first run and combine three or more substances or combine two or more substances in the middle. Further, similarly, it is also possible to connect three or more fluid mixers and mix other substances in stages.

Next, embodiments of various combinations of substances which are mixed by the present apparatus will be explained.

In the apparatus of FIG. 14, it is possible to run water through the line 60 through which one substance flows and to run a pH adjuster, liquid fertilizer, bleach, bactericide, surfactant, or liquid chemical through the line 61 through which the other substance flows so as to be mixed and made uniform by an apparatus using the fluid mixer 65.

The water at this time may be pure water, distilled water, tap water, industrial water, etc. It is not particularly so long as meeting the conditions of the substance to be mixed with. Further, the temperature of the water is also not particularly limited. Warm water or cold water may be used.

The pH adjuster need only be an acid or alkali used for adjusting the pH of the liquids to be mixed. Hydrochloric acid, sulfuric acid, nitric acid, fluoric acid, carbonic acid, citric acid, gluconic acid, succinic acid, potassium carbonate, sodium hydrogen carbonate, sodium hydroxide aqueous solution, etc. may be mentioned.

The liquid fertilizer may be any liquid fertilizer for agricultural use. Manure or a chemical fertilizer etc. may be mentioned.

The bleach may be any one which utilizes the oxidation and reduction reaction of a chemical substance to break down color. Sodium hypochlorite, sodium percarbonate, hydrogen peroxide, ozone water, thiourea dioxide, etc. may be mentioned.

A bactericide is a chemical for killing microorganisms having pathogenicity or toxicity. An iodine tincture, povidone iodine, sodium hypochlorite, chloride of lime, mercurochrome, chlorhexidine gluconate, acrinol, ethanol, isopropanol, hydrogen peroxide aqueous solution, benzalkonium chloride, cetylpyridinium chloride, saponated cresol solution, sodium chlorite, hydrogen peroxide, sodium hypochlorite, hypochlorous acid water, ozone water, etc. may be mentioned.

The surfactant is a substance having parts in the molecule with affinity with water (hydrophilic groups) and parts with affinity with oil (lyophilic groups and hydrophobic groups). A fatty acid sodium salt, fatty acid potassium salt, monoalkyl sulfuric acid salt, alkyl polyoxyethylene sulfuric acid salt, alkylbenzene sulfonic acid salt, monoalkyl phosphoric acid salt, alkyltrimethyl ammonium salt, dialkyldimethyl ammonium salt, alkylbenzyl dimethyl ammonium salt, alkyldimethylamine oxide, alkylcarboxybetaine, polyoxyethylene alkyl ether, fatty acid sorbitan ester alkylpolyglucoside fatty acid diethanolamide, alkylmonoglyceryl ether, α-sulfofatty acid ester sodium salt, linear alkylbenzenesulfonic acid sodium salt, alkylsulfonic acid ester sodium salt, alkylether sulfonic acid ester sodium salt, α-olefin sulfonic acid sodium salt, alkyl sulfonic acid sodium salt, sucrose fatty acid ester sorbitan fatty acid ester, polyoxyethylene sorbitan fatty acid ester, fatty acid alkanolamide, polyoxyethylene alkyl ether, polyoxyethylene alkyl phenyl ether, alkyl amino fatty acid sodium salt, alkylbetaine, alkylaminoxide, alkyltrimethyl ammonium salt, dialkyldimethyl ammonium salt, etc. may be mentioned.

Further, so long as within the range of liquid chemicals, a liquid chemical which does not fall under the above categories may also be used. Hydrochloric acid, sulfuric acid, acetic acid, nitric acid, formic acid, fluoric acid, sodium hydroxide, potassium hydroxide, calcium hydroxide, barium hydroxide, ammonium hydroxide, sodium silicate, oil, etc. may be mentioned. Note that, the liquid chemicals mentioned here are also used chemicals corresponding to the above categories. Further, it is also possible to run cold water through the line 60 through which one substance flows and run hot water through the line 61 through which the other substance flows and to mix the cold water and hot water to give a uniform, constant temperature.

Further, it is also possible to run a first liquid chemical through the line 60 through which one substance flows and run a second liquid chemical or metal through the line 61 through which the other substance flows so as to be mixed by an apparatus using the fluid mixer 65. The first and second liquid chemicals to be mixed here may be any liquid chemicals which can be mixed. The above liquid chemicals or other liquid chemicals may also be used. For example, photoresist and thinner etc. may be mentioned. Further, the liquid chemical may also be a cosmetic. As the cosmetic, a facial cleanser, cleansing solution, toilet water, beauty essence, milky lotion, cream, gel, or other such foundation cosmetic aimed at preparing the skin itself or medicinal use and other products, corresponding to "quasi drugs" in Japan, aimed at preventing bad breath, body odor, heat rashes, sores, hair loss, etc., at promoting hair growth or removing hair, driving away mice or insects, etc. may be mentioned.

The metal is mainly an organometallic compound and is used as fine granules, a powder, or as a liquid obtained by dissolution in an organic solvent etc. As the organometallic compound, organozinc compounds such as chloro(ethoxycarbonylmethyl)zinc, organocopper compounds such a lithium dimethyl cuprate, Grignard reagents, organomagnesium compounds such as iodo(methyl)magnesium and diethyl magnesium, organolithium compounds such as n-butyl lithium, metal carbonyl, carbene complexes, ferrocene and other metallocenes and other organometallic compounds, single element or multiple element mixed standard solutions dissolved in paraffin oil, etc. may be mentioned. Further, silicon, arsenic, boron, and other semimetal compounds or aluminum or other such base metals are included. The organic metal compound is suitably used as a catalyst in the production of a petrochemical product or the production of an organic polymer.

Further, it is also possible to run a waste liquid through the line 60 through which one substance flows and run a pH adjuster or flocculant through the line 61 through which the other substance flows so as to be mixed by an apparatus using the fluid mixer 65. The pH adjuster used may be the above pH adjuster. The flocculant is not particularly limited so long as causing flocculation of the waste liquor. Ammonium sulfate, polyferrous sulfate, polyaluminum chloride, polysilica iron, calcium sulfate, ferrous chloride, slaked lime, etc. may be mentioned. The microorganism need only be one which promotes fermentation or breakdown of waste liquor. A mold, yeast, or other fungi, bacteria or other microorganisms etc. may be mentioned.

Further, it is possible to run a first petroleum oil through the line 60 through which one substance flows and run a second petroleum oil, additive, or water through the line 61 through which the other substance flows so as to be mixed by an apparatus using the fluid mixer 65. Here, the "first and second petroleum oils" mean liquid oils having hydrocarbons as main ingredients and also containing small amounts of sulfur, oxygen, nitrogen, and various other substances. Naphtha (gasoline), kerosine, diesel oil, heavy oil, lubricating oil, asphalt, etc. may be mentioned. The "additive" referred to here indicates something which is added to improve or maintain the quality of petroleum oil. As a lubrication oil additive, a detergent dispersant, antioxidant, viscosity index improver/pour point depressant, oiliness agent/extreme pressure additive, antiwear agent, antirust/anticorrosive agent, etc. may be mentioned, while as a grease additive, a structural stabilizer, filler, or other fuel oil additive etc. may be mentioned. The water referred to here may be pure water, distilled water, tap water, industrial water, etc. It is not particularly limited so long as water meeting the conditions of the substances to be mixed. Further, the temperature of the water is not particularly limited. Hot water or cold water may be used.

Further, it is also possible to run a first resin through the line 60 through which one substance flows and run a second resin, solvent, curing agent, and coloring agent through the line 61 through which the other substance flows so as to be mixed by an apparatus using the fluid mixer 65. The "resin" referred to here is a molten resin, liquid resin, or other main ingredient of an adhesive or coat forming ingredient of a coating. The molten resin is not particularly limited so long as a resin which can be injection molded or extruded. Polyethylene, polypropylene, polyvinyl chloride, polystyrene, tetrafluoroethylene-perfluoroalkyl vinyl ether copolymer, ABS resin, acryl resin, polyamide, nylon, polyacetal, polycarbonate, modified polyphenylene ether, polybutylene terephthalate, polyethylene terephthalate, polyphenylene sulfide, polyether ether ketone, etc. may be mentioned.

As the liquid resin or other main ingredient of an adhesive, an acrylic resin-based adhesive, α-olefin-based adhesive, urethane resin-based adhesive, ether-based cellulose, ethylene-vinyl acetate resin adhesive, epoxy resin-based adhesive, vinyl chloride resin solvent-based adhesive, chloroprene rubber-based adhesive, vinyl acetate resin-based adhesive, cyanoacrylate-based adhesive, silicone-based adhesive, water-based polymer-isocyanate-based adhesive, styrene-butadiene rubber solution-based adhesive, styrene-butadiene rubber-based latex adhesive, nitrile rubber-based adhesive, nitrocellulose adhesive, reactive hot melt adhesive, phenol resin-based adhesive, modified silicone-based adhesive, polyamide resin hot melt adhesive, polyimide-based adhesive, polyurethane resin hot melt adhesive, polyolefin resin hot melt adhesive, polyvinyl acetate resin solution-based adhesive, polystyrene resin solvent-based adhesive, polyvinyl alcohol-based adhesive, polyvinyl pyrrolidone resin-based adhesive, polyvinyl butyral resin-based adhesive, polybenzimidazole adhesive, polymethacrylate resin solution-based adhesive, melamine resin-based adhesive, urea resin-based adhesive, resorcinol-based adhesive, etc. may be mentioned. As the coating forming ingredient of the coating, an acryl resin, urethane resin, melamine resin, etc. may be mentioned.

As the solvent, hexane, benzene, toluene, diethyl ether, chloroform, ethyl acetate, tetrahydrofuran, methylene chloride, acetone, acetonitrile, dimethylsulfoxide, dimethylformamide, dimethylacetoamide, N-methylpyrrolidone, ethanol, methanol, etc. may be mentioned. As the curing agent, polyamine, acid anhydrides, amines, peroxides, saccharin, etc. may be mentioned. As the coloring agents, zinc white, lead white, lithopone, titanium dioxide, precipitated barium sulfate, barite powder, red lead, iron oxide red, yellow lead, zinc yellow, ultramarine blue, potassium ferrocyanide, carbon black, and other pigments may be mentioned.

Here, when the above resin is a molten resin, it is also possible to form an apparatus running molten resin from a molding machine or extruder to the fluid mixer 65 (not shown). For example, in the case of a molding machine, it is possible to arrange the fluid mixer 65 between the nozzle of the molding machine and mold for injection molding or, in the case of an extruder, arrange the fluid mixer 65 between the extruder and die for extrusion. In this case, it is possible to make the temperature in the resin uniform, stabilize the viscosity of the resin, suppress unevenness of thickness or generation of internal stress, and eliminate unevenness of color.

Further, it is also possible to run a first food material through the line 60 through which one substance flows and to run a second food material, food additive, seasoning, or nonflammable gas through the line 61 through which the other substance flows so as to be mixed by an apparatus using the fluid mixer 65.

The first and second food materials need only be beverages or foods which can flow through pipelines. Sake rice wine, shochu distilled spirits, beer, whisky, wine, vodka, and other alcoholic beverages, milk, yoghurt, butter, cream, cheese, condensed milk, milk fat, and other milk products, juice, tea, coffee, soymilk, water, and other beverages, soup stock, miso soup, consommé soup, corn soup, tonkotsu pig bone soup, and other liquid foods, and also jelly, konjak powder paste, pudding, chocolate, ice cream, candies, tofu, paste products, beaten egg, gelatin, and other various food materials etc. may be mentioned. Further, if fluid in nature, a solid or powder is also possible. Flour, potato starch, strong wheat flour, weak wheat flour, buckwheat flour, powdered milk, coffee, cocoa, and other powder materials or meat, wakame seaweed, sesame seeds, green layer, kezuribushi dried fish shavings, bread crumbs, minced or grated food or other small solid foods etc. may be mentioned.

As the food additive, brown sugar, evaporated cane juice, fructose, maltose, honey, molasses, maple syrup, starch syrup, erythritol, trehalose, maltitol, palatinose, xylitol, sorbitol, somatin, saccharin sodium, cyclamic acid, dulcin, aspartame, acesulfame potassium, sucralose, neotame, or other sweeteners, caramel color, gardenia coloring, anthocyanin coloring, annatto coloring, paprika coloring, safflower coloring, monascus coloring, flavonoid coloring, cochineal coloring, Amaranth, Erythrosine, Allura Red AC, New Coccine, Phloxine, Rose Bengal, Acid Red, Tartrazine, Sunset Yellow FCF, Fast Green FCF, Brilliant Blue FCF, Indigo Carmine, and other coloring agents, sodium benzoate, ε-polylysine, soft roe protein extract (protamine), potassium sorbate, sodium, sodium dehydroacetate, Thujaplicin (hinokitol), or other preservatives, ascorbic acid, tocopherol, dibutyl hydroxytoluene, butyl hydroxyanisole, sodium erythorbate, sodium sulfite, sulfur dioxide, chlorogenic acid, catechinic acid, or other antioxidants, flavors and fragrances, etc. may be mentioned.

As the seasoning, soysauce, sauce, vinegar, oil, chile sauce, miso soybean paste, ketchup, mayonnaise, salad dressing, sweet sake, and other liquid seasonings or sugar, salt, pepper, Japanese pepper, powdered red pepper, and other powder seasonings etc. may be mentioned. Microorganisms promote the fermentation and breakdown of food and include mushrooms, mold, yeast, or other fungi and bacteria and other microorganisms. As the fungi, various types of mushrooms, *aspergillus*, etc. may be mentioned. As the bacteria, for example, *lactobacillus bifidus, lactobacillus, bacillus subtilis natto*, etc. may be mentioned. As the nonflammable gas, carbon dioxide gas etc. may be mentioned. For example, the mixer can be used for mixing sweet wort and carbon dioxide gas to produce beer.

Further, it is also possible to run air through the line 60 through which one substance flows and run a flammable gas through the line 61 through which the other substance flows so as to be mixed by an apparatus using the fluid mixer 65. As the flammable gas, methane, ethane, propane, butane, pentane, acetylene, hydrogen, carbon monoxide, ammonia, dimethyl ether, etc. may be mentioned.

Further, it is also possible run a first nonflammable gas through the line 60 through which one substance flows and run a second nonflammable gas or steam through the line 61 through which the other substance flows so as to be mixed by an apparatus using the fluid mixer 65. As the nonflammable gas, nitrogen, oxygen, carbon dioxide, argon gas, helium gas, hydrogen sulfide gas, sulfurous acid gas, sulfur oxide gas, etc. may be mentioned. Further, as another combination of the above, it is also possible to run water, a liquid chemical, or a food material through the line 60 through which one substance flows and run air, a nonflammable gas, or steam through the line 60 through which the other substance flows so as to be mixed by an apparatus using the fluid mixer 65.

Further, it is also possible to run a first synthesis intermediate through the line 60 through which one substance flows and run the second synthesis intermediate, additives, liquid chemicals, or metal through the line 61 through which the other substance flows so as to be mixed by an apparatus using the fluid mixer 65. The first and second synthesis intermediates mean compounds at the stage in the middle of synthesis appearing in the middle of the multistage synthesis process until the target compound. Compounds in the middle of synthesis obtained by mixing a plurality of chemicals, resins in the middle of refinement, pharmaceutical intermediates, etc. may be mentioned.

Note that the combinations of substances to be mixed by the above apparatus using a fluid mixer of FIG. 14 may also be combined using the apparatus of FIG. 15 etc. Further, in the apparatuses using fluid mixers of FIG. 14 and FIG. 15, it is also possible to provide a heater or vaporizer at each of the lines through which substances flow before merging (not shown) and possible to provide heat exchangers at the downstream side of the fluid mixers (not shown). Further, it is also possible to set a measuring device at a line through which one substance flows before merging and provide a control unit for adjusting the output of the pump of the line through which the other substance flows in accordance with a parameter measured by that measuring device (not shown) or to set a control valve at the line through which the other substance flows and provide another control valve for adjusting the opening degree of that control valve in accordance with a parameter of that measuring device (not shown). At this time, the measuring device may be any which can measure a parameter of the fluid required such as a flowmeter, current meter, densitometer, or pH meter. Further, it is also possible to install a static mixer in the flow path at the downstream side of the merging part of the lines. The fluid mixer may be used to make flow uniform in the axial direction of the flow path, while the static mixer may be used to make the flow uniform in the diametrical direction of the flow path, so the fluid can be mixed more uniformly.

Note that, the present invention was explained in detail based on specific embodiments, but a person skilled in the art could make various modifications, corrections, etc. without departing from the claims and idea of the present invention.

REFERENCE SIGNS LIST

1 first flow path
2 spiral flow path
3 second flow path
4*a* to 4*e* branch flow path
5 fluid inlet
6 fluid outlet
7 main body part
8 fluid inlet
9 first flow path
10 fluid outlet
11 second flow path
12 spiral groove
13 communicating hole
14 cylindrical member
15 spiral flow path
41 first flow path
42 spiral flow path
43 second flow path
44*a* to 44*e* branch flow path
45 fluid inlet
46 fluid outlet
47 main body part
48 fluid outlet
49 second flow path
50 spiral groove
51 communicating hole
52 cylindrical member
53 spiral flow path
54 fluid inlet
55 first flow path

The invention claimed is:

1. A fluid mixer comprising a fluid inlet, a first flow path connected to said fluid inlet, a spiral flow path connected to said first flow path, a plurality of branch flow paths branched from said spiral flow path, a second flow path to which said plurality of branch flow paths are connected, and a fluid outlet connected to said second flow path, said plurality of branch flow paths branching from different positions of said spiral flow path and being connected with the second flow path at different positions of said second flow path, said fluid mixer further comprising a main body part having two end faces and being formed so that said fluid inlet is arranged at one end face, said fluid outlet is arranged at the other end face, a spiral groove is formed at an outer circumference of the main body part, said second flow path is arranged coaxially with a center axis of a spiral of said spiral groove, and a plurality of communicating holes communicate said second flow path and said spiral groove and a housing fitting with an outer circumferential surface of said main body part, said spiral groove and the inner circumferential surface of said housing forming said spiral flow path, and said communicating holes being said branch flow paths.

2. A fluid mixer as set forth in claim 1, wherein said spiral flow path is formed so that a flow section area becomes gradually smaller from one end connected with said first flow path toward said fluid outlet.

3. A fluid mixer as set forth in claim 1, wherein an inner circumferential surface of said second flow path is formed gradually expanding in diameter from an upstream side toward said fluid outlet.

4. A fluid mixer as set forth in claim 1, wherein said communicating holes are formed to be the same in flow section areas.

5. A fluid mixer as set forth in claim 1, wherein said housing is provided with a ferrule coupling part.

6. A fluid mixer as set forth in claim 1, wherein said housing is formed by two or more members, each said member is provided with a flange part, and said flange parts are fastened by clamps.

7. A fluid mixer as set forth in claim 6, wherein said housing is comprised of two cylindrical parts, an outer circumference of one end part of each said cylindrical part is provided with a flange part, while the other end part is provided with a reduced diameter part which is reduced in diameter, and said main body part is inserted into opening parts of said two cylindrical parts at said flange part sides, and said flange parts are fastened by clamps.

8. A fluid mixer as set forth in claim 1, wherein said housing is comprised of a body provided with a hollow chamber opening at the bottom, said hollow chamber having an inlet flow path and outlet flow path communicated with it, and a lid member closing an opening of said hollow chamber, and said main body part is arranged fit into the hollow chamber of said housing.

9. An apparatus comprising a fluid mixer as set forth in claim 1 to make a temperature or concentration of a flowing substance uniform in a line in which the temperature or concentration of the substance changes over time.

10. An apparatus comprising a fluid mixer as set forth in claim 1, wherein said fluid mixer is arranged at a downstream side of a merging part of a line in which at least two substances flow.

11. A fluid mixer comprising a fluid inlet, a first flow path connected to said fluid inlet, a spiral flow path connected to said first flow path, a plurality of branch flow paths branched from said spiral flow path, a second flow path to which said plurality of branch flow paths are connected, and a fluid outlet connected to said second flow path, said plurality of branch flow paths branching from different positions of said spiral flow path and being connected with the second flow path at different positions of said second flow path, said fluid mixer further comprising a main body part formed so that said fluid outlet is arranged at one end face, a spiral groove is formed at an outer circumference, said second flow path is arranged coaxially with a center axis of a spiral of said spiral groove, and a plurality of communicating holes communicate said second flow path and said spiral groove and a housing fitting with an outer circumferential surface of said main body part, said fluid inlet being formed at an outer circumference of said housing, said spiral groove and the inner circumferential surface of said housing forming said spiral flow path, and said communicating holes being said branch flow paths.

* * * * *